US006275757B1

(12) United States Patent
Watanabe et al.

(10) Patent No.: US 6,275,757 B1
(45) Date of Patent: Aug. 14, 2001

(54) DEVICE FOR CONTROLLING LIMITED-AREA EXCAVATION WITH CONSTRUCTION MACHINE

(75) Inventors: Hiroshi Watanabe, Ushiku; Kazuo Fujishima; Masakazu Haga, both of Ibaraki-ken, all of (JP)

(73) Assignee: Hitachi Construction Machinery Co. Ltd., Tokyo (JP)

( * ) Notice: Subject to any disclaimer, the term of this patent is extended or adjusted under 35 U.S.C. 154(b) by 0 days.

(21) Appl. No.: 09/242,633

(22) PCT Filed: Jun. 18, 1998

(86) PCT No.: PCT/JP98/02691

§ 371 Date: Feb. 19, 1999

§ 102(e) Date: Feb. 19, 1999

(87) PCT Pub. No.: WO98/59118

PCT Pub. Date: Dec. 30, 1998

(30) Foreign Application Priority Data

Jun. 20, 1997 (JP) ..... 9-163870

(51) Int. Cl.[7] ..... G06F 7/00

(52) U.S. Cl. ..... 701/50; 37/234; 172/6; 340/686.1

(58) Field of Search ..... 701/35, 50; 37/234, 37/348, 414, 416, 443; 340/679, 686.1; 414/669; 172/2, 3, 5, 6, 12

(56) References Cited

FOREIGN PATENT DOCUMENTS 5-280067 10/1993 (JP) .
5-311692 11/1993 (JP) .
6-17446 1/1994 (JP) .
6-73760 3/1994 (JP) .
8-319631 12/1996 (JP) .
8-333768 12/1996 (JP) .
8-333769 12/1996 (JP) .
WO95/30059 11/1995 (WO) .
WO95/33100 12/1995 (WO) .

*Primary Examiner*—William A. Cuchlinski, Jr.
*Assistant Examiner*—Edward Pipala
(74) *Attorney, Agent, or Firm*—Mattingly, Stanger & Malur

(57) ABSTRACT

An area limiting excavation control system in an excavation machine having a front device, includes means for setting in advance, an area where the front device is movable. A control unit calculates the position and posture of the front device based on signals from angle sensors. When the front device is inside the set area near the boundary thereof, the control unit calculates a limit value (a) of a bucket tip speed so that a moving speed of the front device in the direction vertical to the boundary of the set area is restricted, and then modifies the limit value (a) depending on a load pressure of an arm cylinder detected by a pressure sensor. It further calculates, from the limit value (a), a limit value of the component of a boom-dependent bucket tip speed vertical to the boundary of the set area, and then modifies a boom operation signal so that the boom-dependent bucket tip speed will not exceed the above limit value. Ground can be excavated to the boundary of the set area without being affected by hardness of the ground to be excavated, while using a simple program.

8 Claims, 23 Drawing Sheets

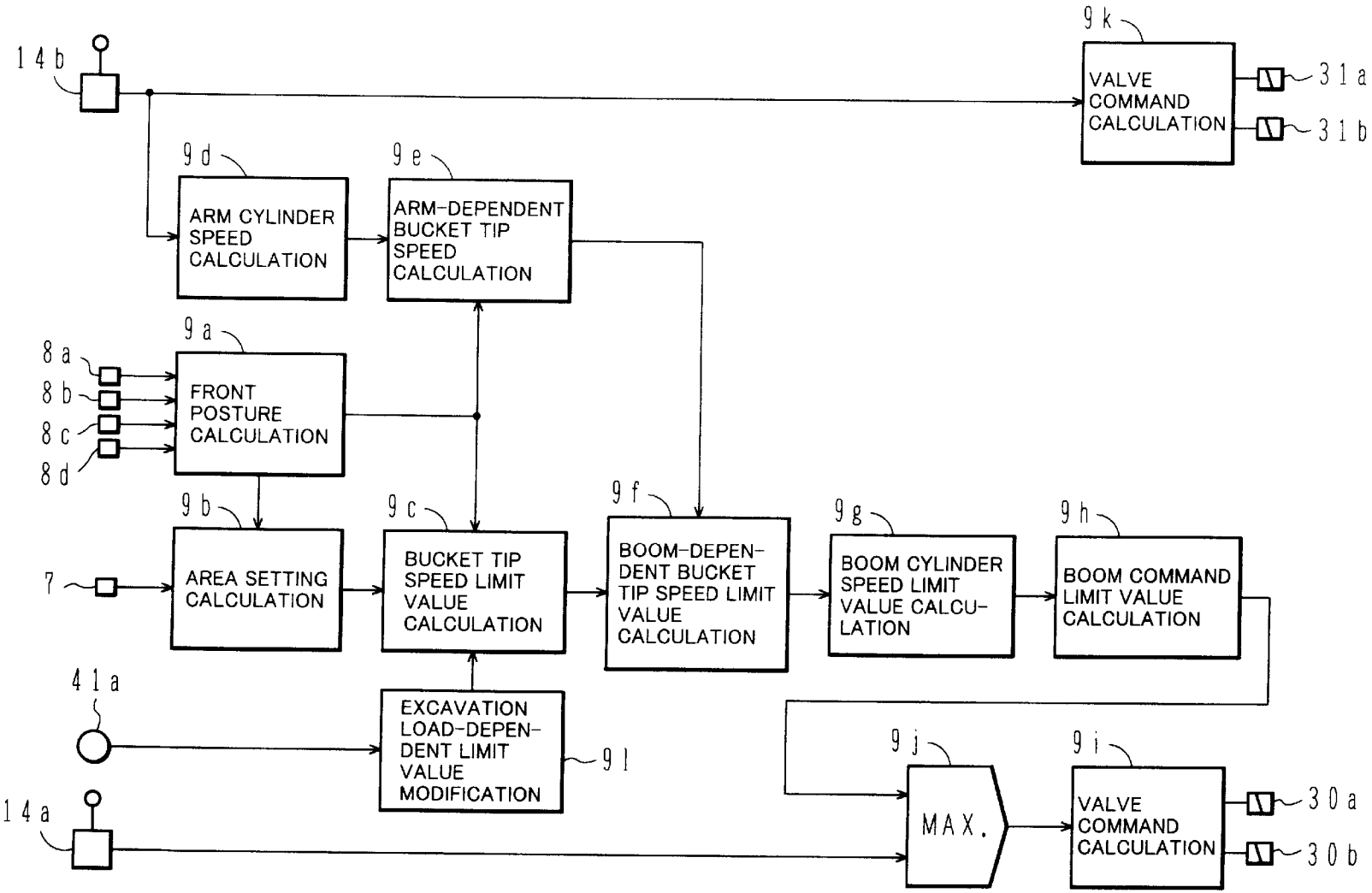
FIG.3
VALVE COMMAND CALCULATION
9k
31a
31b
ARM CYLINDER SPEED CALCULATION
9d
ARM-DEPENDENT BUCKET TIP SPEED CALCULATION
9e
FRONT POSTURE CALCULATION
9a
AREA SETTING CALCULATION
9b
BUCKET TIP SPEED LIMIT VALUE CALCULATION
9c
BOOM-DEPEN-DENT BUCKET TIP SPEED LIMIT VALUE CALCULATION
9f
BOOM CYLINDER SPEED LIMIT VALUE CALCU-LATION
9g
BOOM COMMAND LIMIT VALUE CALCULATION
9h
EXCAVATION LOAD-DEPEN-DENT LIMIT VALUE MODIFICATION
9l
MAX.
9j
VALVE COMMAND CALCULATION
9i
30a
30b
14b
8a
8b
8c
8d
7
41a
14a

DEVICE FOR CONTROLLING LIMITED-AREA EXCAVATION WITH CONSTRUCTION MACHINE

TECHNICAL FIELD

The present invention relates to an area limiting excavation control system which can perform excavation while limiting an area where a front device is movable, and which is installed in a construction machine having a multi-articulated front device, and particularly, in a hydraulic excavator having a front device comprised of front members such as an arm, a boom and a bucket.

BACKGROUND ART

In a hydraulic excavator, front members such as a boom are operated by an operator manipulating respective manual control levers. However, because the front members are coupled to each other through articulations for relative rotation, it is very difficult to carry out excavation work within a predetermined area by operating the front members. In view of the above, area limiting excavation control systems are proposed in JP, A, 8-333768, WO 95/30059 and WO 95/33100, aiming to facilitate such excavation work.

The area limiting excavation control system for a construction machine disclosed in JP, A, 8-333768 comprises a multi-articulated front device made up of a plurality of front members being rotatable in a vertical direction, a plurality of hydraulic actuators for driving the plurality of front members, a plurality of operating means for instructing operation of the plurality of front members, and a plurality of hydraulic control valves driven upon manipulation of the plurality of operating means and controlling respective flow rates of a hydraulic fluid supplied to the plurality of hydraulic actuators, wherein the control system further comprises area setting means for setting an area where the front device is movable; first detecting means for detecting status variables relating to the position and posture of the front device; first calculating means for calculating the position and posture of the front device based on signals from the first detecting means; second calculating means for calculating the speed of the front device which depends on driving of at least a first particular actuator associated with a first particular front member among the plurality of hydraulic actuators; third calculating means for receiving values calculated by the first and second calculating means and calculating, based on the received values, a limit value of the speed of the front device which depends on driving of at least a second particular actuator associated with a second particular front member among the plurality of hydraulic actuators so that when the front device is inside the set area near the boundary thereof, the moving speed of the front device in the direction toward the boundary of the set area is restricted; and signal modifying means for modifying an operation signal from the operating means associated with the second particular actuator so that the speed of the front device which depends on driving of the second particular actuator will not exceed the limit value. When the front device is inside the set area near the boundary thereof, the third calculating means calculates a limit value of the speed of the front device which depends on driving of the second particular actuator associated with the second particular front member, and the signal modifying means modifies an operation signal from the operating means associated with the second particular actuator so that the speed of the front device which depends on driving of the second particular actuator will not exceed the limit value. Therefore, direction change control is carried out in such a manner as to slow down motion of the front device in the direction toward the boundary of the set area, enabling the front device to be moved along the boundary of the set area. It is hence possible to smoothly and efficiently perform excavation with the boundary of the set area set as a target excavation plane, while a bucket is kept from moving out beyond the boundary of the set area, i.e., the set depth of excavation.

According to the area limiting excavation control system disclosed in WO 95/30059, an area where a front device is movable is set beforehand. A control unit calculates the position and posture of the front device based on signals from angle sensors, and also calculates a target speed vector of the front device based on signals from control lever units. When the front device is inside the set area not near the boundary thereof, the target speed vector is maintained as it is. When the front device is inside the set area near the boundary thereof, the target speed vector is modified to reduce a vector component in the direction toward the boundary of the set area. Hydraulic control valves are then operated so that the modified target speed vector is obtained. As a result, excavation in a limited area can efficiently and smoothly performed.

According to the area limiting excavation control 1system disclosed in WO 95/33100, in consideration of the fact that the metering characteristic of a hydraulic control valve I(flow control valve) changes depending on the load of a front device in the control system disclosed in WO 95/30059, the function relationship used in a target pilot pressure calculating portion is modified in accordance with change in load of the metering characteristic of the flow control valve, and a target pilot pressure is calculated using the modified function relationship. Highly accurate control can be thus achieved regardless of load change so that a tip of the front device moves as per the target speed vector.

DISCLOSURE OF THE INVENTION

When carrying out excavation work, generally, hardness of the ground to be excavated is not uniform in the whole area to be excavated. The ground often includes an area where hardness is partly increased. There is, for example, such a ground condition that the nature of a part of the ground is harder than the other part, or that stones, concrete, scrap wood, etc. are locally piled in the ground. If the prior art proposed in the above-cited JP, A, 8-333768 is applied to excavation work under such a ground condition, the front device fails to move at the speed of the front device that is calculated by the second calculating means, and the direction change control is no longer performed in an appropriate manner.

Supposing, for example, the case that in a condition By where the front device is extended forwardly of the body of a construction machine, i.e., in a condition where a boom as one component of the front members is moved in the lowering direction and an arm is operated in the rising (dumping) direction with respect to the boom, the arm is moved in the crowding direction to perform excavation work under the area limiting excavation control. In such a case, when a bucket reaches a hard ground portion, the load of an arm driving actuator is increased, whereupon a hydraulic fluid becomes harder to flow into the arm driving actuator. Therefore, the arm performs the crowding operation at a lower speed than commanded. As a result, the speed of the front device calculated by the second calculating means is higher than the actual speed of the front device, and the limit value is calculated based on the relatively higher speed to perform control for moving the boom in the rising direction. Hence, the boom is positioned too high relative to the arm crowding operation, and the locus, along which a bucket tip moves until reaching the boundary of the set area, tends to depart away from the boundary in the rising direction.

For that reason, in the above application example, the bucket cannot sufficiently excavate the hard ground portion and the hard ground portion therefore remains only partly excavated, and an unexpected projection is left on the excavation plane. This has raised the problem that additional work must be performed several times to complete the excavation to the boundary of the set area, and a working time required for forming the target excavation plane is increased to such an extent as to delay the scheduled term of work.

Also, with the prior art proposed in WO 95/30059, when a bucket reaches a hard ground portion under a similar ground condition, a tip of the bucket cannot be moved as per the calculated target speed vector, and the locus, along which the bucket tip moves until reaching the boundary of the set area, tends to depart away from the boundary in the rising direction. Thus, the direction change control is no longer performed in an appropriate manner.

With the prior art disclosed in WO 95/33100, the function relationship used in the target pilot pressure calculating portion is modified in accordance with change in load of the metering characteristic of the flow control valve, and the target pilot pressure is calculated using the modified function relationship. Highly accurate control can be thus achieved regardless of load change so that the bucket tip moves as per the calculated target speed vector. This prior art is based on the concept of making an actual movement speed vector of the bucket tip coincident with the calculated target speed vector at whatever load, thereby improving control accuracy. However, this prior-art method requires collecting and registering of a large amount of modification data to accurately modify the function relationship used in the target pilot pressure calculating portion in accordance with load change. A lot of time and labor are needed for that purpose. In control of the combined operation of a boom and an arm like the area limiting excavation control, particularly, when the posture of the front device is changed upon change in the combined relation of the arm and the boom, load characteristics of associated flow control valves are varied and hence required modification amounts are also varied correspondingly. This means that modification data must be prepared in consideration of all possible combined relations of the arm and the boom. It is, however, very difficult to collect modification data, taking into account all those combined relations. In addition, whenever the model of products is changed and the type of flow control valves is changed, it is needed to prepare data again and store load compensation data.

An object of the present invention is to provide an area limiting excavation control system for a construction machine with which, in excavation work using area limiting excavation control, the ground can be excavated to the boundary of a set area without being affected by hardness of the ground to be excavated, and software necessary for the control can be easily prepared.

To achieve the above object, the present invention provides an area limiting excavation control system installed in a construction machine comprising a multi-articulated front device constituted by a plurality of front members coupled to each other in a relatively vertically rotatable manner, including first and second front members, a plurality of hydraulic actuators including first and second hydraulic actuators to drive the first and second front members, a plurality of operating means including first and second operating means to instruct operation of the first and second front members, and a plurality of hydraulic control valves including first and second hydraulic control valves driven upon operation of the first and second operating means to control respective flow rates of a hydraulic fluid supplied to the first and second hydraulic actuators, the area limiting excavation control system comprising first calculating means for calculating a moving speed of the front device instructed by at least the first operating means among the plurality of operating means, second calculating means for calculating a limit value having an absolute value reduced as the front device comes closer to a boundary of a set area, and signal modifying means for modifying an operation signal from at least the second operating means among the plurality of operating means by using the moving speed calculated by the first calculating means and the limit value calculated by the second calculating means, so that the moving speed of the front device in the direction toward the boundary of the set area is reduced as the front device comes closer to the boundary, while the front device is allowed to move in the direction along the boundary, wherein the area limiting excavation control system further comprises first detecting means for detecting a load acting on the front device; and limit value modifying means for modifying the limit value in accordance with a magnitude of the load detected by the first detecting means.

In the present invention constructed as set forth above, the second calculating means calculates the limit value having an absolute value reduced as the front device comes closer to the boundary of the set area, and the signal modifying means modifies the operation signal from at least the second operating means among the plurality of operating means so that the moving speed of the front device in the direction toward the boundary of the set area is reduced as the front device comes closer to the boundary, while the front device is allowed to move in the direction along the boundary. Therefore, direction change control is performed with respect to the boundary of the set area, enabling the front device to be moved along the boundary of the set area. This feature is the same as that of the prior-art systems disclosed in JP, A, 8-333768, WO 95/30059 and WO 95/33100.

Further, in the present invention, when implementing the above direction change control, the first detecting means detects a load acting on the front device, and limit value modifying means modifies the limit value in accordance with a magnitude of the load detected by the first detecting means. This modification of the limit value results in that when the load is large, the limit value can be made effective only when the bucket tip comes closer to the boundary of the set area than when the load is small. A phenomenon that the front device tends to move upward due to an excavation load is therefore suppressed. As a result, even in a condition where the ground to be excavated is hard and the excavation load is large, it is possible to carry out the excavation until the boundary of the set area without undergoing an effect imposed by hardness of the ground.

In addition, the present invention is based on the concept that when excavating the ground imposing a large load, such as hard ground, under the above area limiting control, it is enough for the front device to be controlled to finally reach the boundary of the set area without departing away from the boundary, along which the excavation is to be performed, irrespective of the speed vector (locus) of the bucket tip until reaching the boundary. The limit value is modified depending on load for that purpose. Therefore, the modification of the limit value is not required to be strictly precise, and software can be very easily prepared as compared with the case of modifying a metering characteristic depending on load.

In the above control system, preferably, the limit value modifying means modifies the limit value to become effective in a position closer to the boundary of the set area as the load detected by the first detecting means and acting on the front device increases.

Also, preferably, the load detected by the first detecting means and acting on the front device is a load pressure of the first hydraulic actuator.

The load detected by the first detecting means and acting on the front device may be a load pressure of the second hydraulic actuator.

Preferably, the limit value modified by the limit value modifying means is a limit value of the speed in the direction toward the boundary of the set area, and the signal modifying means modifies an operation signal from the second operating means so that a component of the speed of the front device in the direction toward the boundary of the set area will not exceed the limit value.

Further, the moving speed of the front device calculated by the first calculating means may be a target speed of the front device, the limit value modified by the limit value modifying means may be a coefficient for modifying a component of the target speed of the front device in the direction toward the boundary of the set area, and the signal modifying means may modify operation signals from the first and second operating means so that the target speed of the front device has a speed component modified in accordance with the coefficient.

Alternatively, the moving speed of the front device calculated by the first calculating means may be a target speed of the front device, the limit value modified by the limit value modifying means may be a limit value for a component of the target speed of the front device in the direction toward the boundary of the set area, and the signal modifying means may modify operation signals from the first and second operating means so that the target speed of the front device has a speed component modified not to exceed the limit value.

Speed limiting means for limiting the moving speed of the front device calculated by the first calculating means in accordance with a magnitude of the load detected by the first detecting means may be provided instead of the limit value modifying means.

Moreover, preferably, the plurality of front members include a boom and an arm of a hydraulic excavator, the first front member is the arm, and the second front member is the boom.

BRIEF DESCRIPTION OF THE DRAWINGS

FIG. 3 is a functional block diagram showing control functions of a control unit.

BEST MODE FOR CARRYING OUT THE INVENTION

Embodiments, in which the present invention is applied to a hydraulic excavator, will be described below with reference to the drawings.

To begin with, a first embodiment of the present invention will be described with reference to FIGS. 1 to 6.

Figure 1:
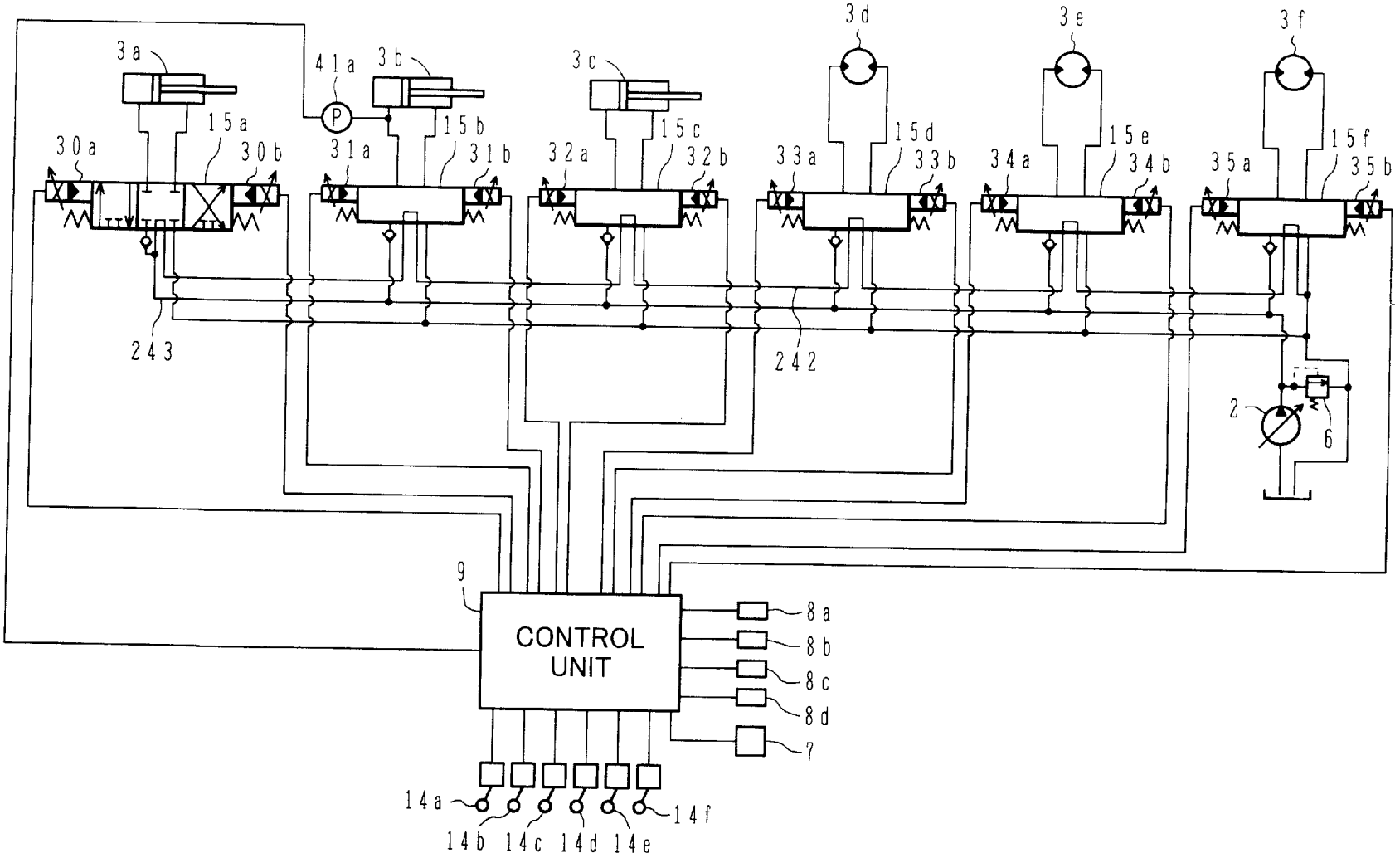
FIG. 1 is a diagram showing an area limiting excavation control system for a construction machine according to a first embodiment of the present invention, along with a hydraulic drive system for the construction machine.

In FIG. 1, a hydraulic excavator, to which the present invention is applied, comprises a hydraulic pump 2, a plurality of hydraulic actuators driven by a hydraulic fluid from the hydraulic pump 2, the hydraulic actuators including a boom cylinder 3*a*, an arm cylinder 3*b*, a bucket cylinder 3*c*, a swing motor 3*d*, and left and right track motors 3*e*, 3*f*, a plurality of control lever units 14*a*–14*f* provided respectively in association with the hydraulic actuators 3*a*–3*f*, a plurality of flow control valves 15*a* 15*f* connected respectively between the hydraulic pump 2 and the plurality of hydraulic actuators 3*a*–3*f* and controlled in accordance with respective operation signals from the control lever units 14*a*–14*f* for controlling respective flow rates of the hydraulic fluid supplied to the hydraulic actuators 3*a*–3*f*, and a relief valve 6 which is opened when the pressure between the hydraulic pump 2 and the flow control valves 15*a*–15*f* exceeds a preset value. The above components constitute a hydraulic drive system for driving driven members of the hydraulic excavator.

A pressure sensor 41*a* is disposed in a bottom side line extending from the arm cylinder 3*b*. The pressure sensor 41*a* detects, in terms of pressure, a load acting on the arm cylinder 3*b* during excavation.

Figure 2:
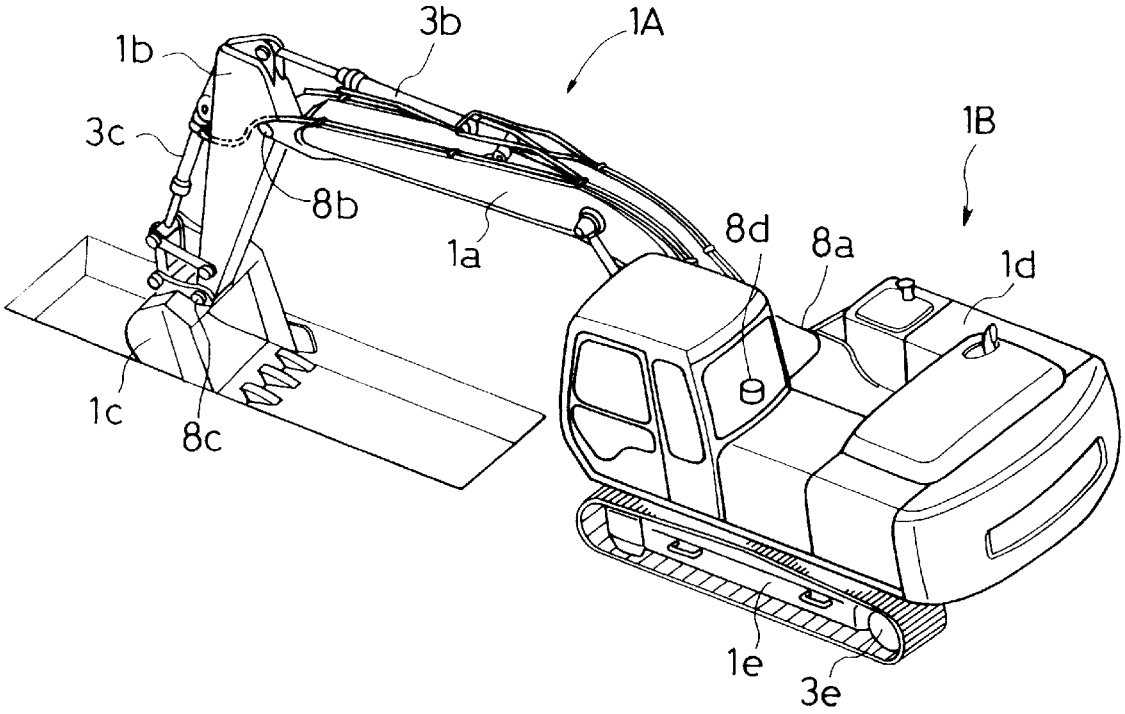
FIG. 2 shows an appearance of a hydraulic excavator to which the present invention is applied.

As shown in FIG. 2, the hydraulic excavator is made up of a multi-articulated front device 1A comprising a boom 1*a*, an arm 1*b* and a bucket 1*c* which are coupled to each other in a relatively rotatable manner in the vertical direction, and a body 1B comprising an upper swing structure 1*d* and a lower travel structure 1*e*. The boom 1*a* of the front device 1A has its base end supported to a front portion of the upper structure 1*d*. The boom 1*a*, the arm 1*b*, the bucket 1*c*, the upper swing structure 1*d* and the lower travel structure 1*e* constitute driven members which are driven respectively by the boom cylinder 3*a*, the arm cylinder 3*b*, the bucket cylinder 3*c*, the swing motor 3*d*, and the left and right track motors 3*e*, 3*f*. These driven members are operated in accordance with instructions from the control lever units 14*a*–14*f*.

The control lever units 14*a*–14*f* are each of electric lever type outputting an electric signal (voltage) as an operation signal. The flow control valves 15*a*–15*f* are provided at their both ends with solenoid driving sectors 30*a*, 30*b*–35*a*, 35*b* having electro-hydraulic converting means, e.g., proportional solenoid valves. The control lever units 14*a*–14*f* supply voltages depending on the amounts and directions of inputs entered by the operator, as electric signals, to the solenoid driving sectors 30*a*, 30*b*–35*a*, 35*b* of the associated flow control valves 15*a* 15*f*.

Further, the flow control valves 15*a*–15*f* are center bypass flow control valves of which center bypass passages are connected in series by a center bypass line 242. The center bypass line 242 is connected at its upstream end to the hydraulic pump 2 through a supply line 243, and at its downstream end to a reservoir.

An area limiting excavation control system of this embodiment is installed in the hydraulic excavator constructed as explained above. The control system comprises a setting unit 7 for providing an instruction to set an excavation area beforehand where a predetermined part of the front device, e.g., a tip of the bucket 1*c*, is movable, depending on the scheduled work, angle sensors 8*a*, 8*b*, 8*c* disposed respectively at pivotal points of the boom 1*a*, the arm 1*b* and the bucket 1*c* for detecting respective rotational angles thereof as status variables relating to the position and posture of the front device 1A, an inclination angle sensor 8*d* for detecting an inclination angle of the body 1B in the forth-and-back direction, and a control unit 9 for receiving operation signals from the control lever units 14*a*–14*f*, a set signal from the setting unit 7, and detection signals from the angle sensors 8*a*, 8*b*, 8*c*, the inclination angle sensor 8*d* and the pressure sensor 41*a*, setting the excavation area where the tip of the bucket 1*c* is movable, and modifying the operation signals so as to perform control for excavation within a limited area.

The setting unit 7 includes operating means, such as a switch, disposed on a control panel or a grip for outputting a set signal to the control unit 9 to instruct setting of the excavation area. Other suitable aid means such as a display unit may also be provided on the control panel.

Control functions of the control unit 9 are shown in FIG. 3. The control unit 9 has functions executed by a front posture calculating portion 9*a*, an area setting calculating portion 9*b*, a bucket tip speed limit value calculating portion 9*c*, an excavation load-dependent limit value modifying portion 91, an arm cylinder speed calculating portion 9*d*, an arm-dependent bucket tip speed calculating portion 9*e*, a boom-dependent bucket tip speed limit value calculating portion 9*f*, a boom cylinder speed limit value calculating portion 9*g*, a boom command limit value calculating portion 9*h*, a boom command maximum value calculating portion 9*j*, a boom-associated valve command calculating portion 9*i*, and an arm-associated valve command calculating portion 9*k*.

The front posture calculating portion 9*a* calculates the position and posture of the front device 1A based on the rotational angles of the boom, the arm and the bucket detected by the angle sensors 8*a*–8*c*, as well as the inclination angle of the body 1B in the forth-and-back direction detected by the inclination angle sensor 8*d*.

The area setting calculating portion 9*b* executes calculation for setting of the excavation area where the tip of the bucket 1*c* is movable, in accordance with an instruction from the setting unit 7. One example of a manner of setting the excavation area will be described with reference to FIG. 4.

Figure 4:
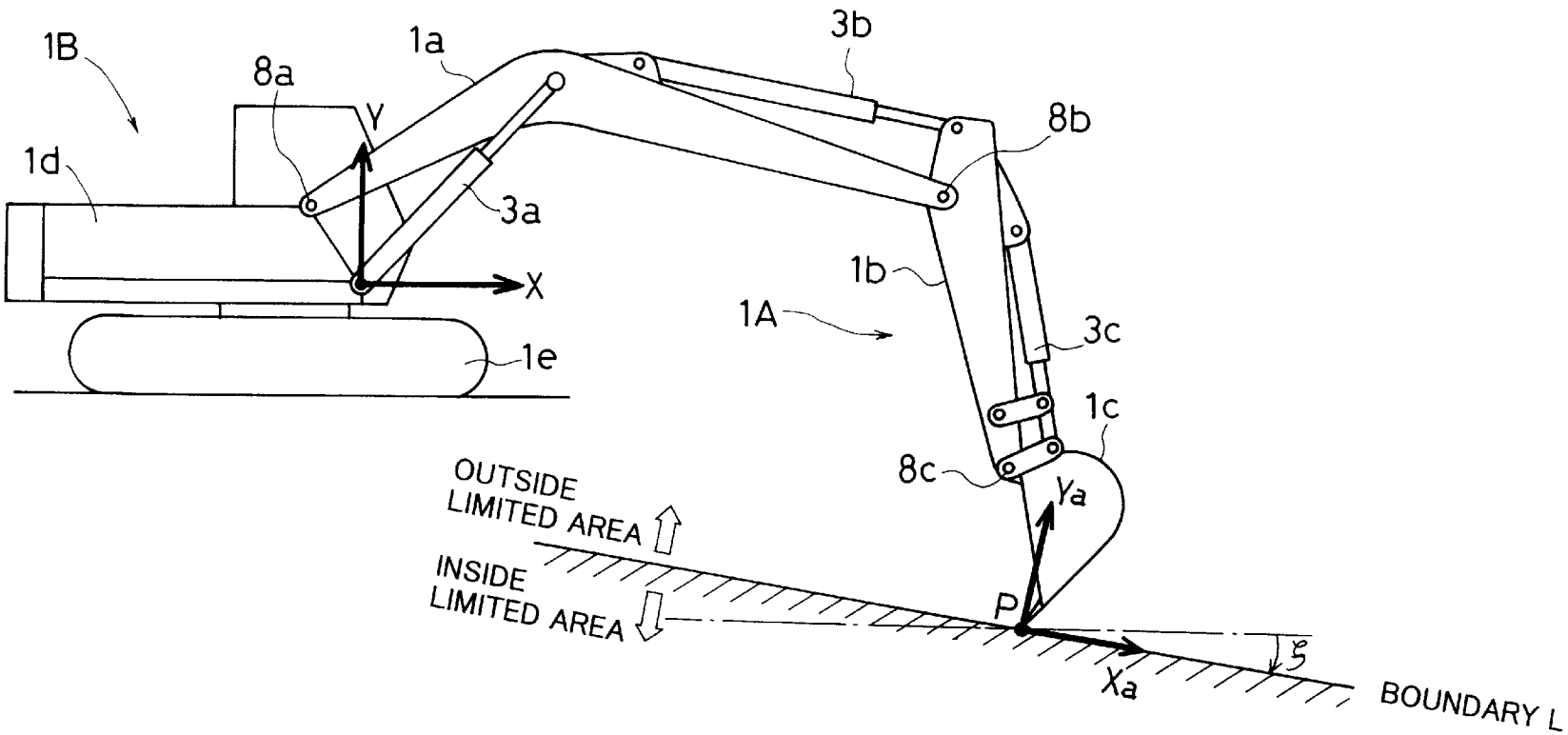
FIG. 4 is a representation for explaining a manner of setting an excavation area in area limiting excavation control of this embodiment.

In FIG. 4, after the operator has operated the front device to move the tip of the bucket 1*c* to the position of a point P, the area setting calculating portion 9*b* receives the tip position of the bucket 1*c* at that time, that is calculated in the front posture calculating portion 9*a*, in response to an instruction from the setting unit 7, and then sets the boundary L of the limited excavation area based on an inclination angle ζ which is also instructed from the setting unit 7.

More specifically, a memory in the control unit 9 stores various dimensions of the components of the front device 1A and the body 1B. For setting the limited excavation area in the area setting calculating portion 9*b*, the front posture calculating portion 9*a* calculates the position of the point P based on the stored data, the rotational angles detected by the angle sensors 8*a*, 8*b*, 8*c*, and the inclination angle of the body 1*b* detected by the inclination angle sensor 8*d*. At this time, the position of the point P is determined as coordinate values on the XY-coordinate system with the origin defined at, for example, the pivotal point of the boom 1*a*. The XY-coordinate system is an orthogonal coordinate system fixed on the body 1B and assumed to exist in a vertical plane.

Then, the area setting calculating portion 9*b* determines a formula expressing the straight line, which corresponds to the boundary L of the limited excavation area, based on the calculated position of the point P and the inclination angle ζ instructed from the setting unit 7. The calculating portion 9*b* further sets an orthogonal coordinate system having the origin on the above straight line and one axis defined by the above straight line, for example, an XaYa-coordinate system with the origin defined at the point P, and then determines transform data from the XY-coordinate system to the XaYa-coordinate system.

The bucket tip speed limit value calculating portion 9*c* calculates a limit value a of the component of the bucket tip speed vertical to the boundary L based on a distance D from the boundary L to the bucket tip. This calculation is carried out by storing the relationship, as shown in FIG. 5, in the memory of the control unit 9 beforehand and reading out the stored relationship.

Figure 5:
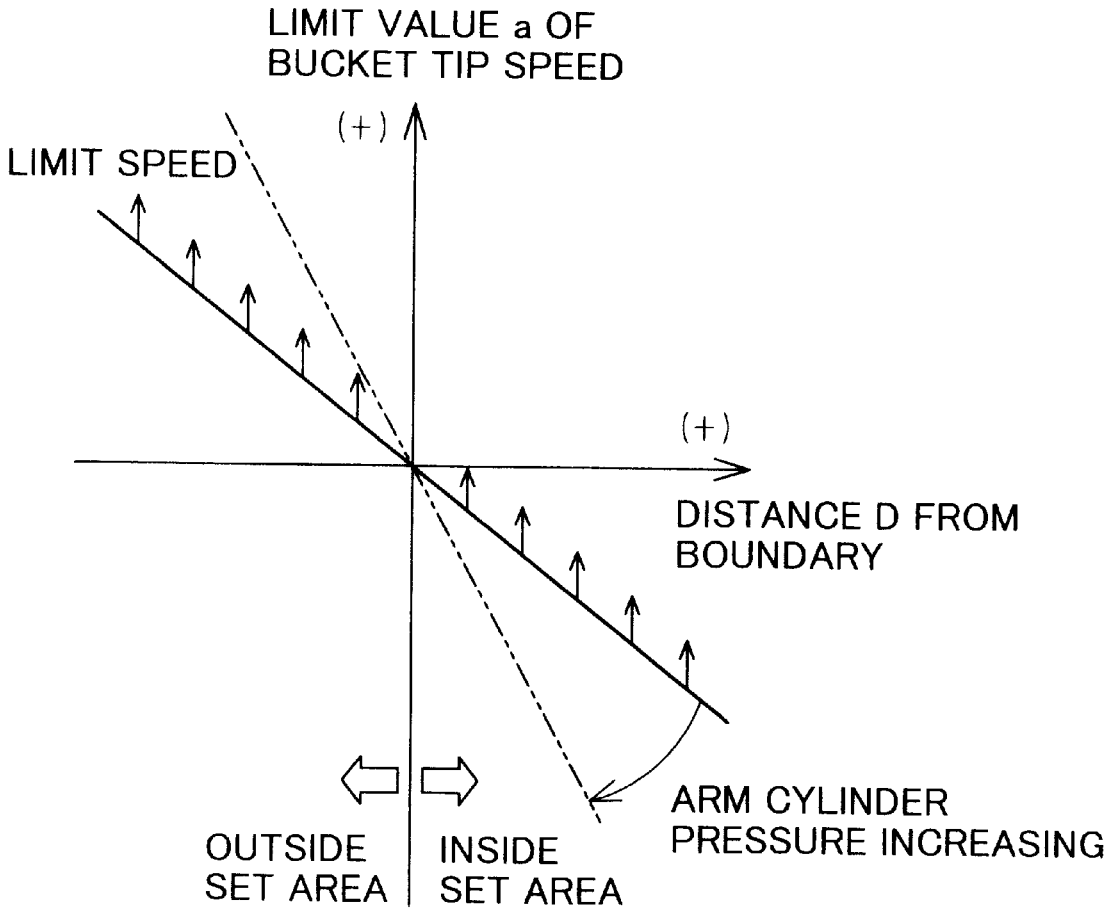
FIG. 5 is a graph showing one example of the relationship between a limit value of the speed of a bucket tip and a distance of the bucket tip from the boundary of the set area, the relationship being used to determine the limit value of the bucket tip speed.

In FIG. 5, the horizontal axis represents the distance D from the boundary L to the bucket tip, and the vertical axis represents the limit value a of the component of the bucket tip speed vertical to the boundary L. As with the XaYa-coordinate system, the distance D represented by the horizontal axis and the limit value a represented by the vertical axis are each defined to be positive (+) in the direction toward the inside of the set area from the outside of the set area. The relationship between the distance D and the limit value a is set such that when the bucket tip is inside the set area, a speed in the negative (−) direction proportional to the distance D is given as the limit value a of the component of the bucket tip speed vertical to the boundary L, and when the bucket tip is outside the set area, a speed in the positive (+) direction proportional to the distance D is given as the limit value a of the component of the bucket tip speed vertical to the boundary L. Accordingly, inside the set area, the bucket tip is slowed down only when the component of the bucket tip speed vertical to the boundary L exceeds the limit value in the negative (−) direction, and outside the set area, the bucket tip is sped up in the positive (+) direction.

The excavation load-dependent limit value modifying portion 91 receives a load pressure Pba of the arm cylinder 3*b* from the pressure sensor 41*a*, and modifies the relationship between the limit value a of the bucket tip speed and the distance D from the boundary to the bucket tip to have a steeper gradient in accordance with an increase of the load pressure Pba, as indicated by change from a solid line to a two-dot-chain line in FIG. 5. Here, the reason why the limit value modifying portion 91 takes in, as a load pressure, the bottom-side pressure Pba of the arm cylinder 3*b* is that excavation work is effected by pulling the arm toward the body, i.e., by supplying the hydraulic fluid to flow into the bottom side of the arm cylinder 3*b* against the excavation load. Also, the reason why the relationship between the limit value a of the bucket tip speed and the distance D from the boundary to the bucket tip is modified to-have a steeper gradient in accordance with an increase of the load pressure Pba is that, at a larger excavation load, the limit value provides an effective modification at a point closer to the boundary when the bucket tip approaches the boundary.

In the bucket tip speed limit value calculating portion 9*c*, the limit value a is determined based on the relationship between the limit value a of the bucket tip speed and the distance D from the boundary to the bucket tip that is modified depending on the load pressure as shown in FIG. 5.

Practical examples of a manner of modifying the limit value a of the bucket tip speed depending on change of the load pressure Pba in the limit value modifying portion 91 will be described below.

(1) Manner of determining compensation coefficient (Ka) of D-a relation formula in FIG. 5 beforehand as function formula of load pressure Pba.

Figure 6:
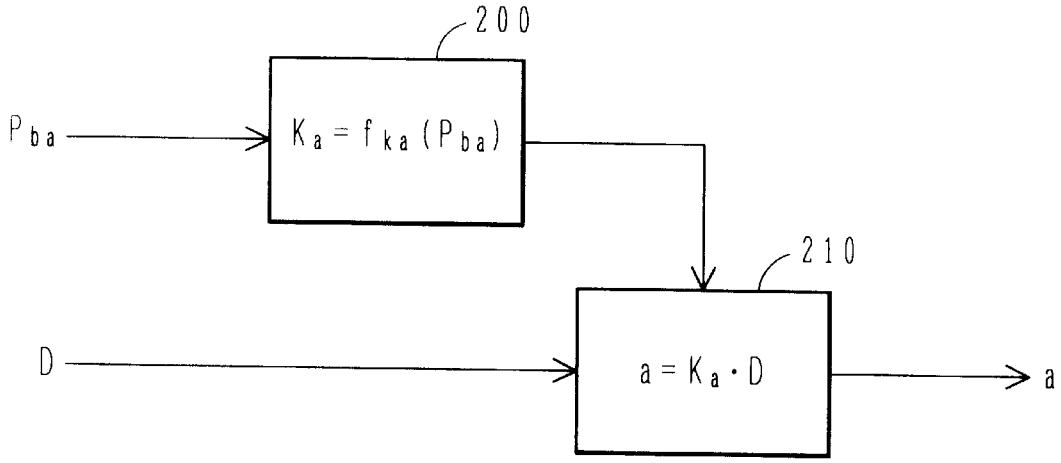
FIG. 6 is a functional block diagram showing one example of a calculation process in a limit value modifying portion.
Figure 7:
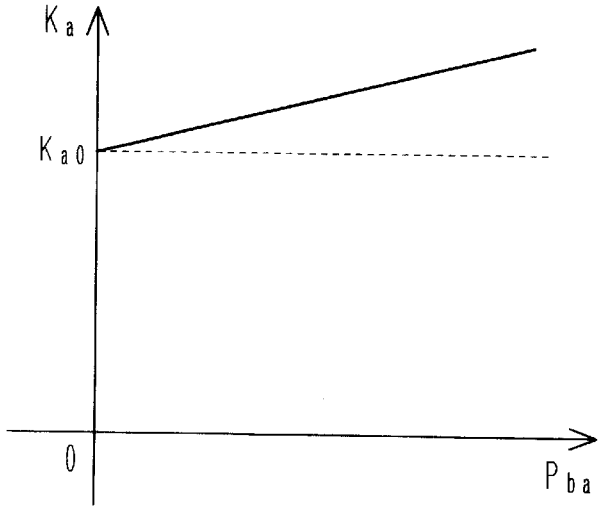
FIG. 7 is a graph showing the relationship between a load pressure and a modification coefficient for use in the block diagram of FIG. 6.

FIG. 6 shows a block diagram for the calculation process, and FIG. 7 graphically shows a function (Ka=fka(Pba)) used in a block 200 of FIG. 6.

In the block 200 of FIG. 6, a coefficient Ka of the D-a relation formula shown in FIG. 5, which is used in a block 210, is determined using the relation formula Ka=fka(Pba) shown in FIG. 7.

In a block 210, the limit value a is determined from a relation formula a=Ka·D using the coefficient Ka determined in the block 200.

In the above process, the coefficient Ka is set to increase with an increase of the load pressure Pba in order that the D-a relationship shown in FIG. 5 has a steeper gradient at larger Pba. Also, the function shown in FIG. 7 is selected such that the coefficient Ka has an initial value Ka=Ka0 at Pba=0 and has a larger value than Ka0 as the load pressure Pba increases. However, the Pba-Ka relationship is not limited to the illustrated one, but may be selected such that Ka=Ka0 holds when the load pressure Pba has a predetermined value, and Ka<Ka0 holds when the load pressure Pba is less than the predetermined value. Further, the Pba-Ka relationship may be expressed by a formula representing a curved line rather than a straight line. In other words, the Pba-Ka relationship can be selected optionally so long as the intended control purpose can be achieved while ensuring that Ka increases (the D-a relationship has a steeper gradient) with an increase of the load pressure Pba.

While the Pba-Ka relationship is provided here in the form of a formula, it is also possible to store the Pba-Ka relationship in the memory of the control unit 9 in the form of a table and to read a table value corresponding to the value of the load pressure Pba.

(2) Manner of determining limit value a from D-a relation formula denoted by solid line in FIG. 5 and modifying limit value a depending on load pressure Pba.

Figure 8:
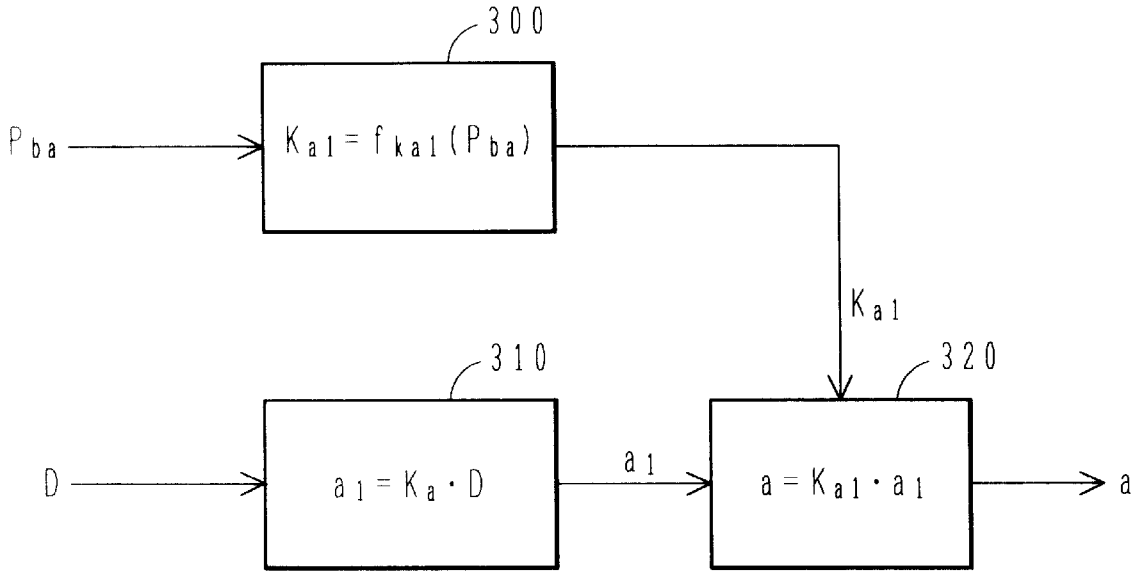
FIG. 8 is a functional block diagram showing another example of the calculation process in the limit value modifying portion.
Figure 9:
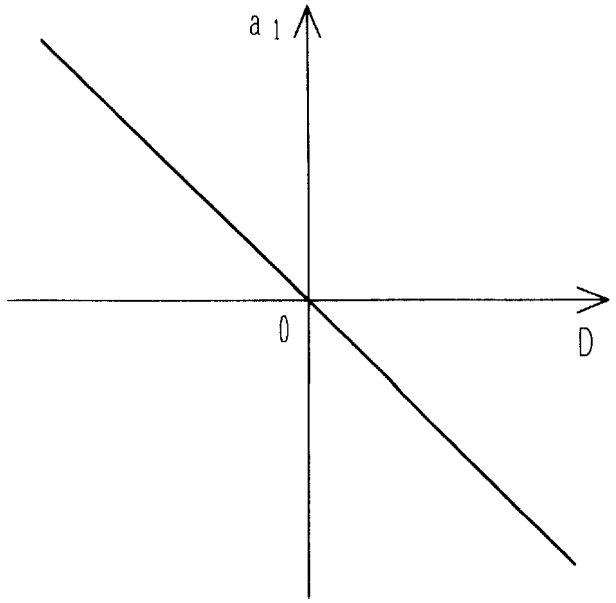
FIG. 9 is a graph showing the relationship between the distance and a basic value of the limit value for use in the block diagram of FIG. 8.
Figure 10:
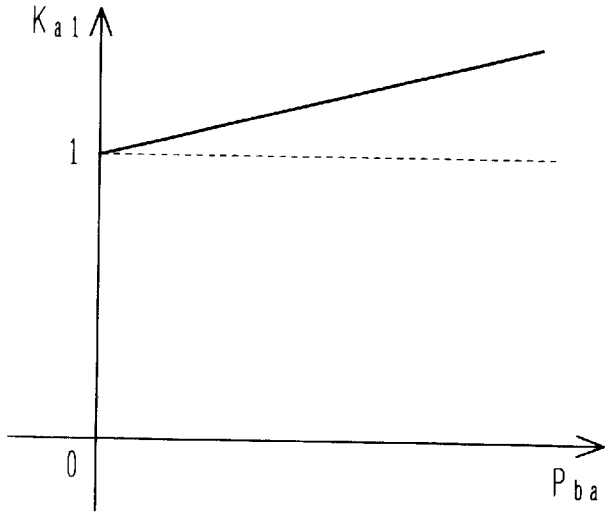
FIG. 10 is a graph showing the relationship between a load pressure and a modification coefficient for use in the block diagram of FIG. 8.

FIG. 8 shows a block diagram for the calculation process, FIG. 9 graphically shows a function (a1=Ka·D (which represent the same relationship as denoted by a solid line in FIG. 5)) used in a block 310 of FIG. 8, and FIG. 10 graphically shows a function (Ka1=fka1(Pba)) used in a block 300 of FIG. 8.

In the block 310, a basic value al of the limit value a of the bucket tip speed is determined from the relation of FIG. 9. In the block 300, a modification coefficient Ka1 of the basic value al depending on the load pressure Pba of the arm cylinder is determined. In a block 320, the limit value a of the bucket tip speed is determined by multiplying the basic value a1, which has been determined in the block 310, by the modification coefficient Ka1 determined in the block 300. In the above process, the Pba-Ka1 relationship is set so that the D-a relationship has a steeper gradient with an increase of the load pressure Pba as denoted by the two-dot-chain line in FIG. 5. Thus, assuming that the basic value al of the limit value a is given at Pba=0, Ka1=1 holds at Pba=0, and the modification coefficient Ka1 increases with an increase of the load pressure Pba, as shown in FIG. 10.

The Pba-Ka1 relationship is not limited to the illustrated one, but may be selected such that Ka1=1 holds when the load pressure Pba has a predetermined value, and Ka1<1 holds when the load pressure Pba is less than the predetermined value. Further, the Pba-Ka1 relationship may be expressed by a formula representing a curved line rather than a straight line. In other words, the Pba-Ka1 relationship can be selected optionally so long as the intended control purpose can be achieved while ensuring that Ka1 increases (the D-a relationship has a steeper gradient) with an increase of the load pressure Pba.

While the Pba-Ka1 relationship is provided here in the form of a formula, it is also possible to store the Pba-Ka1 relationship in the memory of the control unit 9 in the form of a table and to read a table value corresponding to the value of the load pressure Pba.

(3) Manner of storing D-a relationship denoted by solid line in FIG. 5 in memory in the form of a table, calling a corresponding to value of D from memory, and then modifying load pressure Pba.

Figure 11:
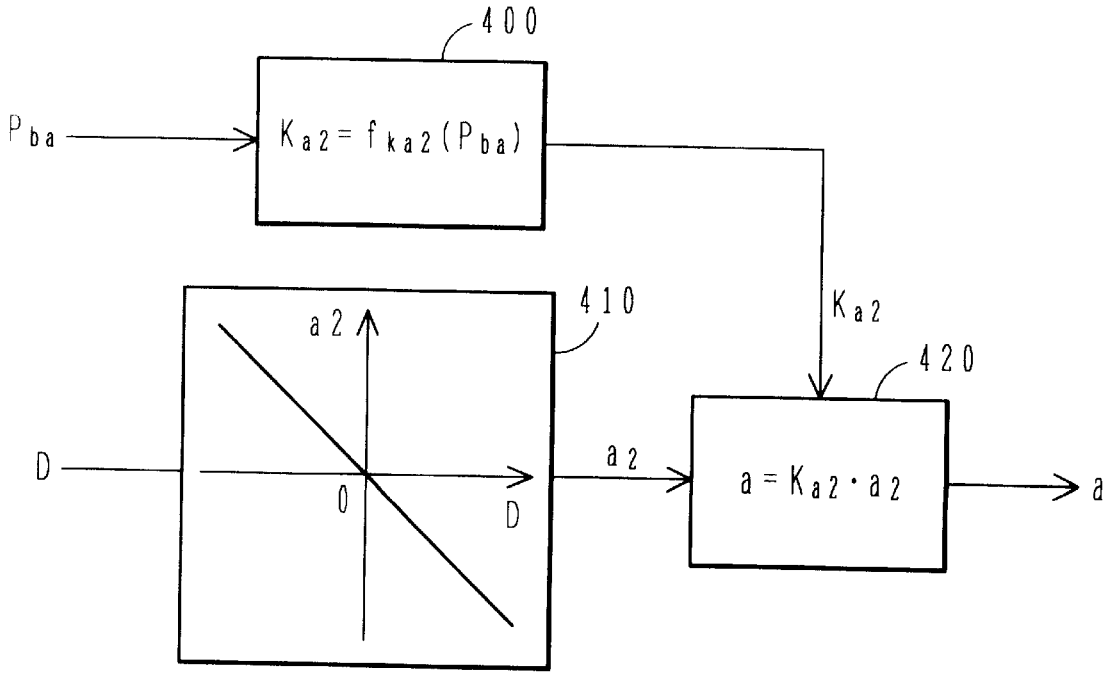
FIG. 11 is a functional block diagram-showing still another example of the calculation process in the limit value modifying portion.

FIG. 11 shows a block diagram for the calculation process.

In a block 410 of FIG. 11, a basic value a2 of the limit value a of the bucket tip speed is determined from a relation formula similar to that representing the solid line in FIG. 5. Here, a D-a2 relationship similar to that denoted by the solid line in FIG. 5 is stored in the memory in the form of a table. Then, the basic value a2 is read from the table depending on the value of the distance D at that time.

In a block 400, a modification coefficient Ka2 of the basic value a2 depending on the load pressure Pba of the arm cylinder is determined. In a block 420, the limit value a of the bucket tip speed is determined by multiplying the basic value a2, which has been determined in the block 410, by the modification coefficient Ka2 determined in the block 400. In the above process, the Pba-Ka2 relationship is set so that the D-a relationship has a steeper gradient with an increase of the load pressure Pba as denoted by the two-dot-chain line in FIG. 5. Thus, assuming that the basic value a2 of the limit value a is given at Pba=0, Ka2=1 holds at Pba=0, and the modification coefficient Ka2 increases with an increase of the load pressure Pba, as with the case of determining Ka1 shown in FIG. 10.

The arm cylinder speed calculating portion 9*d* estimates an arm cylinder speed based on the command value applied from the control lever unit 14*b* to the flow control valve 15*b* and the flow rate characteristic of the flow control valve 5*b* associated with the arm.

The arm-dependent bucket tip speed calculating portion 9*e* calculates an arm-dependent bucket tip speed b based on the arm cylinder speed and the position and posture of the front device 1A determined in the front posture calculating portion 9*a*.

The boom-dependent bucket tip speed limit value calculating portion 9*f* transforms the arm-dependent bucket tip speed b, which has been determined in the calculating portion 9*e*, from the XY-coordinate system to the XaYa-coordinate system by using the transform data determined in the area setting calculating portion 9*b*, then calculates components (bx, by) of the arm-dependent bucket tip speed parallel and vertical to the boundary L, and then calculates a limit value c of the component of the boom-dependent bucket tip speed vertical to the boundary L based on the limit value a of the component of the bucket tip speed vertical to the boundary L determined in the calculating portion 9*c* and the component by of the arm dependent bucket tip speed vertical to the boundary L. That process will be described below with reference to FIG. 12.

Figure 12:
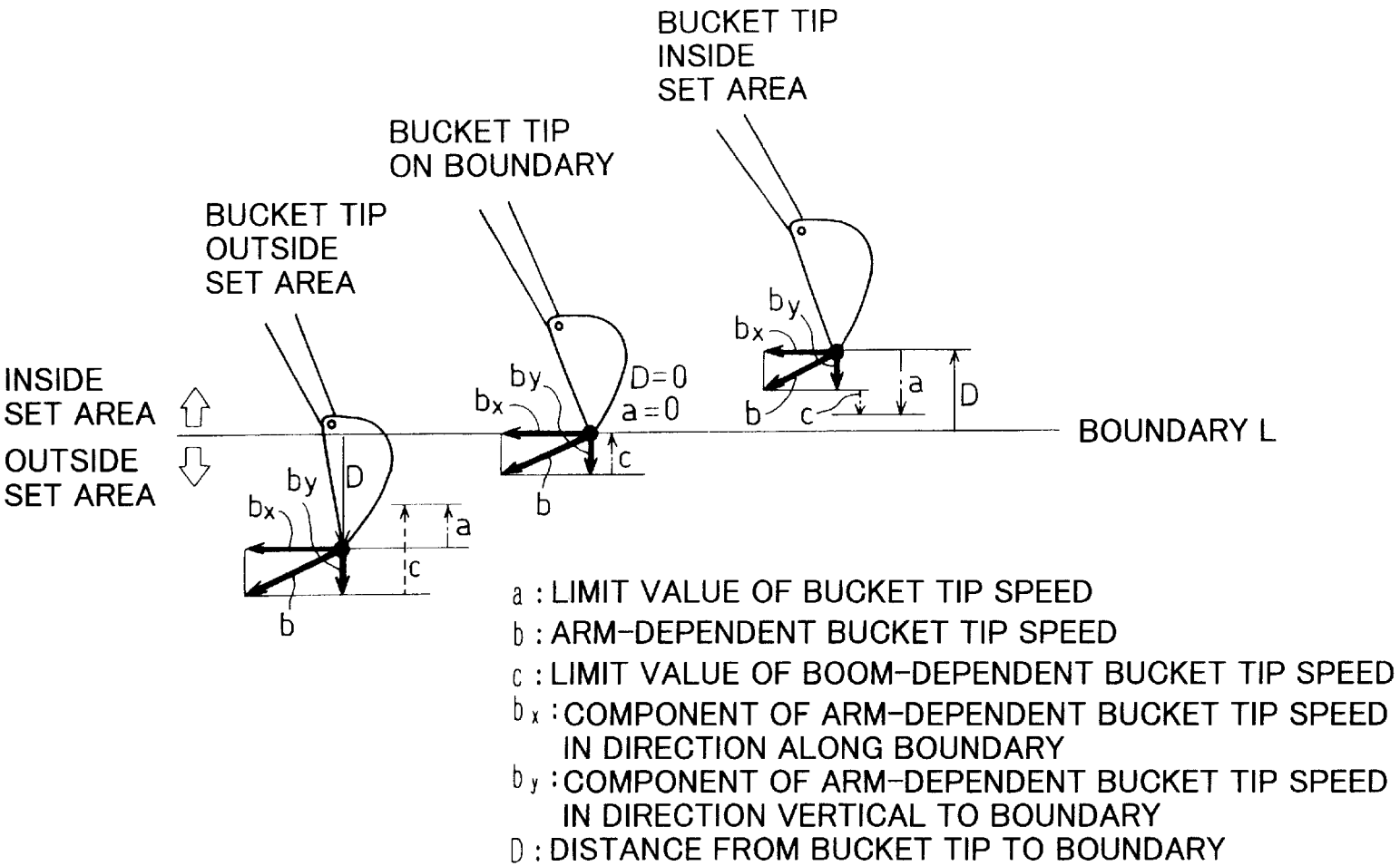
FIG. 12 is a representation showing differences in operation for modifying the bucket tip speed with a boom in the case where the bucket tip is inside the set area, the the case where it is on the boundary of the set area, and the case where it is outside the set area.

In FIG. 12, the difference (a−by) between the limit value a of the component of the bucket tip speed vertical to the boundary L determined in the bucket tip speed limit value calculating portion 9*c* and the component by of the arm-dependent bucket tip speed b vertical to the boundary L determined in the arm-dependent bucket tip speed calculating portion 9*e* provides the limit value c of the boom-dependent bucket tip speed vertical to the boundary L. Then, the boom-dependent bucket tip speed limit value calculating portion 9*f* calculates a limit value c from the formula c=a−by.

The meaning of the limit value c will now be described separately for the case where the bucket tip is inside the set area, the case where the bucket tip is on the boundary of the set area, and for the case where the bucket tip is outside the set area.

When the bucket tip is inside the set area, the bucket tip speed is restricted to the limit value a of the component of the bucket tip speed vertical to the boundary L in proportion to the distance D from the boundary L to the bucket tip, whereby the component of the boom-dependent bucket tip speed vertical to the boundary L is restricted to c (=a−by). Namely, if the component by of the boom-dependent bucket tip speed b vertical to the boundary L exceeds c, the boom is slowed down to c.

When the bucket tip is on the boundary L of the set area, the limit value a of the component of the bucket tip speed vertical to the boundary L is set to zero (0), and the component by of the arm-dependent bucket tip speed toward the outside of the set area is canceled by the boom raising operation to provide the speed c for modification so that the component of the bucket tip speed vertical to the boundary L also becomes zero (0).

When the bucket tip is outside the set area, the component of the bucket tip speed vertical to the boundary L is restricted to the upward speed a in proportion to the distance D from the boundary L to the bucket tip. Thus, the boom raising operation to provide the speed c for modification is performed so that the bucket tip is always returned to the inside of the set area.

The boom cylinder speed limit value calculating portion 9*g* calculates a boom cylinder speed limit value through the coordinate transformation using the aforesaid transform data based on the limit value c of the boom-dependent bucket tip speed vertical to the boundary L and the position and posture of the front device 1A.

The boom command limit value calculating portion 9*h* determines, based on the flow rate characteristic of the flow control valve 15*a* associated with the boom, a boom command limit value corresponding to the boom cylinder speed limit value determined in the calculating portion 9*g*.

The boom command maximum value calculating portion 9*j* compares the boom command limit value determined in the calculating portion 9*h* with the command value from the control lever unit 14*a*, and then outputs the larger of them. Here, as with the XaYa-coordinate system, the command value from the control lever unit 14*a* is defined to be positive (+) when it represents the direction from the outside of the set area to the inside of the set area (i.e., the boom raising direction). Also, the function of the calculating portion 9*j* to output the larger of the boom command limit value and the command value from the control lever unit 14*a* is carried out as follows. When the bucket tip is inside the set area, the limit value c is negative (−) and therefore the calculating portion 9*j* outputs the control lever command value if it is positive (+), and one of both the values which has a smaller absolute value if the control lever command value is negative (−). When the bucket tip is outside the set area, the limit value c is positive (+) and therefore the calculating portion 9*j* outputs the limit value c if the control lever command value is negative (−), and one of both the values which has a larger absolute value if the control lever command value is positive (+).

In the boom-associated valve command calculating portion 9*i*, when the command value output from the boom command maximum value calculating portion 9*j* is positive, a voltage corresponding to the command value is output to the boom-raising driving sector 30*a* of the flow control valve 15*a*, and a zero (0) voltage is output to the boom-lowering driving sector 30*b* thereof. When the command value is negative, the voltages are output in a reversed manner to the above.

The arm-associated valve command calculating portion 9*k* receives the command value from the control lever unit 14*b*. When the command value represents an arm-crowding command value, a voltage corresponding to the command value is output to the arm-crowding driving sector 31*a* of the flow control valve 15*b*, and a zero (0) voltage is output to the arm-dumping driving sector 31*b* thereof. When the command value represents an arm-dumping command value, the voltages are output in a reversed manner to the above.

Operation of this embodiment having the above-explained construction will be described below. The description will be made of several examples of work; the case of operating a control lever of the boom control lever unit 14*a* in the boom lowering direction to move down the boom (i.e., the boom lowering operation) with an intention of positioning the bucket tip, and the case of operating a control lever of the arm control lever unit 14*b* in the arm crowding direction to crowd the arm (i.e., the arm crowding operation) with an intention of excavating the ground toward the body.

When the control lever of the boom control lever unit 14*a* is operated in the boom lowering direction with an intention of positioning the bucket tip, the command value from the control lever unit 14*a* is input to the maximum value calculating portion 9*j*. At the same time, the calculating portion 9*c* calculates, based on the relationship shown in FIG. 5, a limit value a (<0) of the bucket tip speed in proportion to the distance D from the boundary L of the set area to the bucket tip, the calculating portion 9*f* calculates a limit value c=a−by=a (<0) of the boom-dependent bucket tip speed, and the boom command limit value calculating portion 9*h* calculates a negative boom command limit value corresponding to the limit value c. Here, when the bucket tip is far from the boundary L of the set area, the command value from the control lever unit 14*a* is greater than the boom command limit value determined in the calculating portion 9*h*, and therefore the boom command maximum value calculating portion 9*j* selects the command value from the control lever unit 14*a*. Since the selected command value is negative, the valve command calculating portion 9*i* outputs a corresponding voltage to the boom-lowering driving sector 30*b* of the flow control valve 15*a* and a zero (0) voltage to the boom-raising driving sector 30*a*, whereby the boom is gradually moved down in accordance with the command value from the control lever unit 14*a*.

As the boom is gradually moved down and the bucket tip comes closer to the boundary L of the set area as mentioned above, the limit value c=a (<0) of the boom-dependent bucket tip speed calculated in the calculating portion 9*f* is increased (the absolute value jai or Icl is reduced). When the corresponding boom command limit value determined in the calculating portion 9*h* becomes greater than the command value from the control lever unit 14*a*, the boom command maximum value calculating portion 9*j* selects the boom command limit value, and the valve command calculating portion 9*i* gradually restricts the voltage output to the boom-lowering driving sector 30*b* of the flow control valve 15*a* in accordance with the limit value c. Thus, the boom lowering speed is gradually restricted as the bucket tip approaches the boundary L of the set area, and the boom is stopped when the bucket tip reaches the boundary L of the set area. As-a result, the bucket tip can be-easily and smoothly positioned.

Because of the above modifying process being carried out in a speed control manner, if the speed of the front device 1A is extremely fast or the control lever unit 14*a* is abruptly operated, the bucket tip may go out beyond the boundary L of the set area due to a delay in control response, such as a delay caused in the hydraulic circuit, and the force of inertia imposed on the front device 1A. When such an event occurs, the limit value a (=c) of the bucket tip speed in proportion to the distance D from the boundary L of the set area to the bucket tip is calculated as a positive value in the calculating portion 9*c* based on the relationship shown in FIG. 5, and the valve command calculating portion 9*i* outputs a voltage corresponding the limit value c to the boom-raising driving sector 30*a* of the flow control valve 15*a*. The boom is thereby moved in the rising direction at a speed proportional to the distance D for moving back toward the set area, and is then stopped when the bucket tip returns to the boundary L of the set area. As a result, the bucket tip can be more easily positioned.

Further, when the control lever of the arm control lever unit 14*b* is operated in the arm crowding direction with an intention of excavating the ground toward the body, the command value from the control lever unit 14*b* is input to the arm-associated valve command calculating portion 9*k* which outputs a corresponding voltage to the arm-crowding driving sector 31*a* of the flow control valve 15*b*, causing the arm to move down toward the body. At the same time, the command value from the control lever unit 14*b* is input to the calculating portion 9*d* which calculates an arm cylinder speed, and the calculating portion 9*e* calculates an arm-dependent bucket tip speed b. Also, the calculating portion 9*c* calculates, based on the relationship shown in FIG. 5, a limit value a (<0) of the bucket tip speed in proportion to the distance D from the boundary L of the set area to the bucket tip, and the calculating portion 9*f* calculates a limit value c=a−by of the boom-dependent bucket tip speed. Here, when the bucket tip is so far from the boundary L of the set area as to meet the relationship of a<by (|a|>|by|), the limit value c is calculated as a negative value. Therefore, the boom command maximum value calculating portion 9*j* selects the command value (=0) from the control lever unit 14*a*, and the valve command calculating portion 9*i* outputs a zero (0) voltage to both the boom-raising driving sector 30*a* and the boom-lowering driving sector 30*b* of the flow control valve 15*a*. As a result, the arm is moved toward the body in accordance with the command value from the control lever unit 14*b*.

Figure 13:
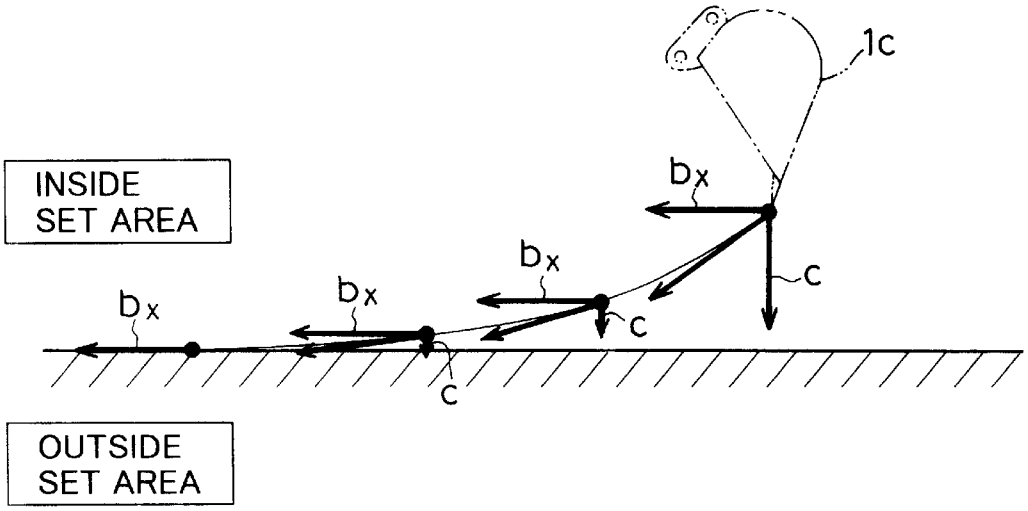
FIG. 13 is a representation showing one example of a locus along which the bucket tip is moved with the modifying operation when it is inside the set area.

As the arm is gradually moved toward the body and the bucket tip comes closer to the boundary L of the set area as mentioned above, the bucket tip speed limit value a calculated in the calculating portion 9*c* is increased (the absolute value |a| is reduced). When the limit value a becomes greater than the component by of the arm-dependent bucket tip speed b vertical to the boundary L determined in the calculating portion 9*e*, the limit value c=a−by of the boom-dependent bucket tip speed calculated in the calculating portion 9*f* is given as a positive value. Accordingly, the boom command maximum value calculating portion 9*j* selects the limit value calculated in the calculating portion 9*h*, and the valve command calculating portion 9*i* outputs a voltage corresponding to the limit value c to the boom-raising driving sector 30*a* of the flow control valve 15*a*. Therefore, the boom raising operation for modifying the bucket tip speed is performed such that the component of the bucket tip speed vertical to the boundary L is gradually restricted in proportion to the distance D from the boundary L to the bucket tip. Thus, direction change control is carried out with a resultant of the unmodified component bx of the arm-dependent bucket tip speed parallel to the boundary L and the above speed modified in accordance with the limit value c, as shown in FIG. 13, enabling the excavation to be performed along the boundary L of the set area.

Here, when the excavation load is enlarged, the hydraulic fluid becomes harder to flow into the arm cylinder 3*b* and the arm speed is lowered. Therefore, the bucket tip speed b calculated in the arm-dependent bucket tip speed calculating portion 9*e* becomes higher than the actual speed. Because the limit value c of the component of the boom-dependent bucket tip speed vertical to the boundary L is calculated in the calculating portion 9*f* based on the resulting higher speed to make control for moving the boom in the rising direction, the rising speed of the boom 1*a* becomes relatively too fast with respect to the arm crowding operation, thus causing a phenomenon that the front device tends to move upward.

In this embodiment, when the excavation load is enlarged and the bottom-side pressure Pba of the arm cylinder 3*b* is increased, the excavation load-dependent limit value modifying portion 91 modifies the limit value a depending on the arm cylinder load. This modification of the limit value a results in that when the load pressure Pba is high, the limit value a has a sufficiently large value only when the bucket tip comes closer to the boundary L than when the load pressure Pba is low. In other words, the boom raising operation for modifying the bucket tip speed becomes effective when the bucket tip comes closer to the boundary L. Therefore, even when the hydraulic fluid becomes harder to flow into the arm cylinder and the arm speed is lowered, the boom rising speed under the direction change control balances with the lowered arm speed, thereby suppressing the phenomenon that the front device tends to move upward. As a result, even in a condition where the load pressure or the excavation load is large, it is possible to carry out the excavation along the boundary L in a closer relation.

Figure 14:
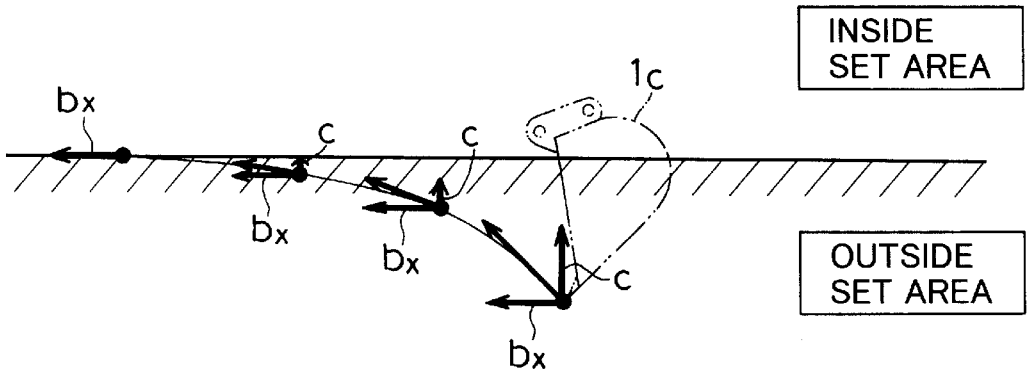
FIG. 14 is a representation showing one example of a locus along which the bucket tip is moved with the modifying operation when it is outside the set area.

Also in the above case, the bucket tip may go out beyond the boundary L of the set area for the reasons stated above. When such an event occurs, the limit value a of the bucket tip speed in proportion to the distance D from the boundary L of the set area to the bucket tip is calculated as a positive value in the calculating portion 9*c* based on the relationship shown in FIG. 5, a limit value c=a−by (>0) of the boom-dependent bucket tip speed calculated in the calculating portion 9*f* is increased in proportion to the limit value a, and the voltage output from the valve command calculating portion 9*i* to the boom raising driving sector 30*a* of the flow control valve 15*a* is increased in accordance with the limit value c. In the case of the bucket tip being outside the set area, therefore, the boom raising operation for modifying the bucket tip speed is performed so that the bucket tip is moved back toward the set area at a speed proportional to the distance D. Thus, the excavation is carried out with a resultant of the unmodified component bx of the arm dependent bucket tip speed parallel to the boundary L and the above speed modified in accordance with the limit value c, enabling the excavation to be performed along the boundary L of the set area while the bucket tip is gradually returned to and moved along the boundary L, as shown in FIG. 14. Consequently, the excavation can be smoothly performed along the boundary L of the set area just by crowding the arm.

With this embodiment, as described above, when the bucket tip is inside the set area, the component of the bucket tip speed vertical to the boundary L of the set area is restricted in accordance with the limit value a in proportion to the distance D from the boundary L to the bucket tip. Accordingly, the bucket tip can be easily and smoothly positioned by the boom lowering operation, and the bucket tip can be moved along the boundary of the set area by the arm crowding operation. As a result, it is possible to smoothly and efficiently perform the excavation within a limited area.

When the bucket tip is outside the set area, the front device is controlled in accordance with the limit value a in proportion to the distance D from the boundary L to the bucket tip so that the front device is returned to the set area. Accordingly, even if the front device is moved fast, it can be moved along the boundary of the set area for precise excavation within a limited area.

In this connection, since the bucket tip is slowed down beforehand under the direction change control as described above, the amount by which the bucket tip goes out beyond the set area is reduced and a shock produced upon the bucket tip returning to the set area is much abated. Accordingly, even if the front device is moved fast, it can be smoothly moved along the boundary of the set area for smooth excavation within a limited area.

Further, even in a condition where the load pressure or the excavation load is large, the excavation can be performed along the boundary L in a closer relation due to suppression of the phenomenon that the hydraulic fluid becomes harder to flow into the arm cylinder and the arm speed is lowered, whereby the boom rising speed prevails and the front device tends to move upward. As a result, even when the ground to be excavated is hard, the number of excavation steps necessary until reaching the boundary L can be reduced.

In addition, the manner of modifying the limit value a in this embodiment is based on the concept that when excavating the ground imposing a large load, such as hard ground, under the area limiting control, it is enough for the front device to be controlled to finally reach the boundary of the set area without departing away from the boundary, along which the excavation is to be performed, irrespective of the speed vector (locus) of the bucket tip until reaching the boundary. Therefore, an accurate value is not required in the process of modifying the limit value a depending on the load pressure, and the control can be performed with rough modification just sufficient to carry out the excavation in such a way that the bucket tip will not depart away from the boundary along which the excavation is to be performed. As a result, the above-mentioned relationship between the load pressure Pba and the modification coefficient Ka or Ka1 or Ka2, that is used in the limit value modifying portion 91, is not required to be strictly precise, and software (program) for use in the limit value modifying portion 91 can be easily prepared.

Figure 15:
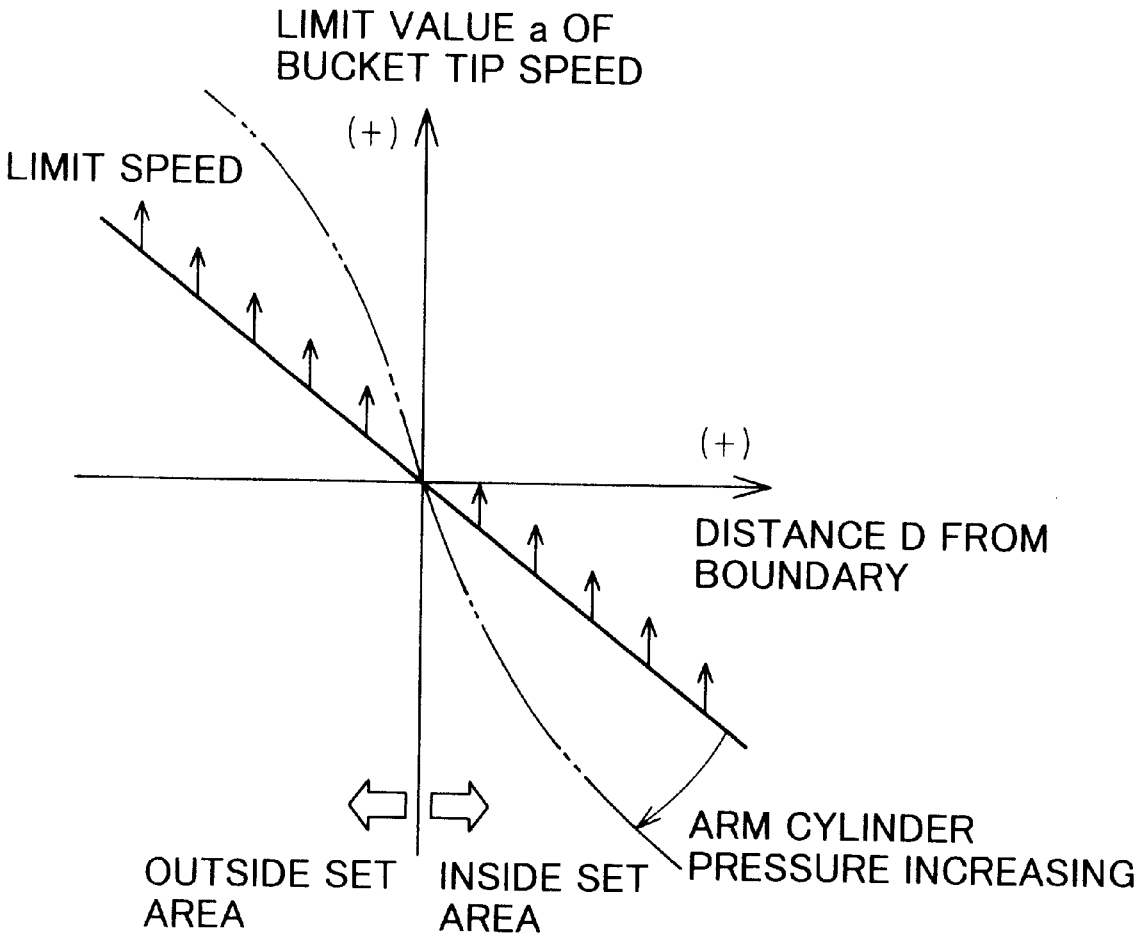
FIG. 15 is a graph showing another example of the relationship between the limit value of the speed of the bucket tip and the distance of the bucket tip from the boundary of the set area, the relationship being used to determine the limit value of the bucket tip speed.

Note that the manner of modifying the relationship between the distance D from the boundary L to the bucket tip and the limit value a of the bucket tip speed is not limited to the manner of modifying the straight line to have a steeper gradient as shown in FIG. 5, and the relationship therebetween may be modified to gradually change from a straight line to a curved line as shown in FIG. 15. This corresponds to that the modification coefficient Ka or Ka1 or Ka2 shown in FIGS. 7 and 10, by way of example, is expressed by a formula representing a curved line. The essential point is to modify the limit value a so that the boom raising operation for modifying the bucket tip speed starts to effect its action at a position closer to the boundary L as the load pressure increases.

Further, while the bottom-side pressure of the arm cylinder is detected as a load in this embodiment, the load may also be determined by, for example, detecting a differential pressure between the bottom side and the rod side of the arm cylinder, or detecting, as load reaction, the pressure acting on the rod side of the arm cylinder 3*a*. Alternatively, those methods may be used in a combined manner to determine a magnitude of the load.

Figure 16:
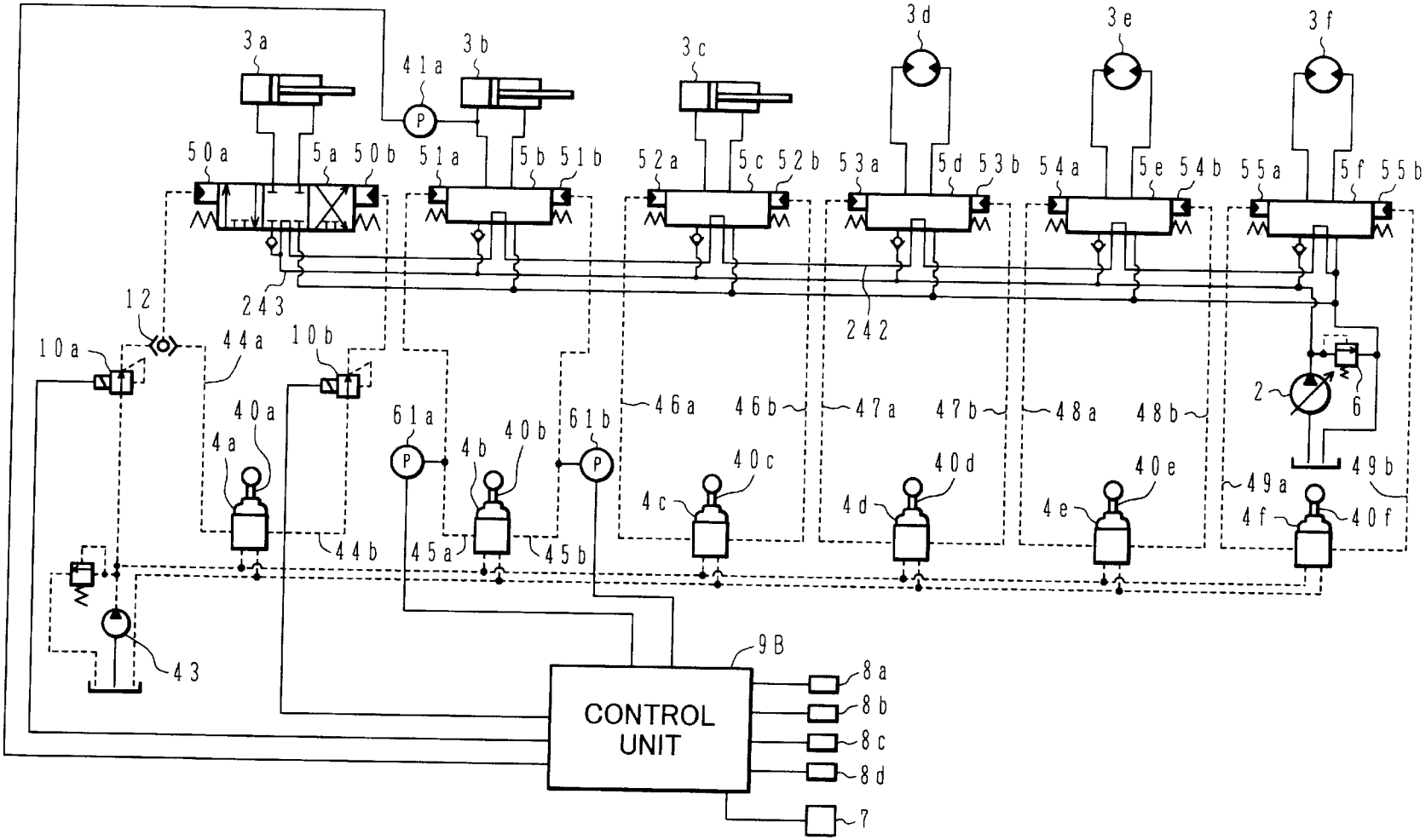
FIG. 16 is a diagram showing an area limiting excavation control system for a construction machine according to a second embodiment of the present invention, along with a hydraulic drive system for the construction machine.
Figure 17:
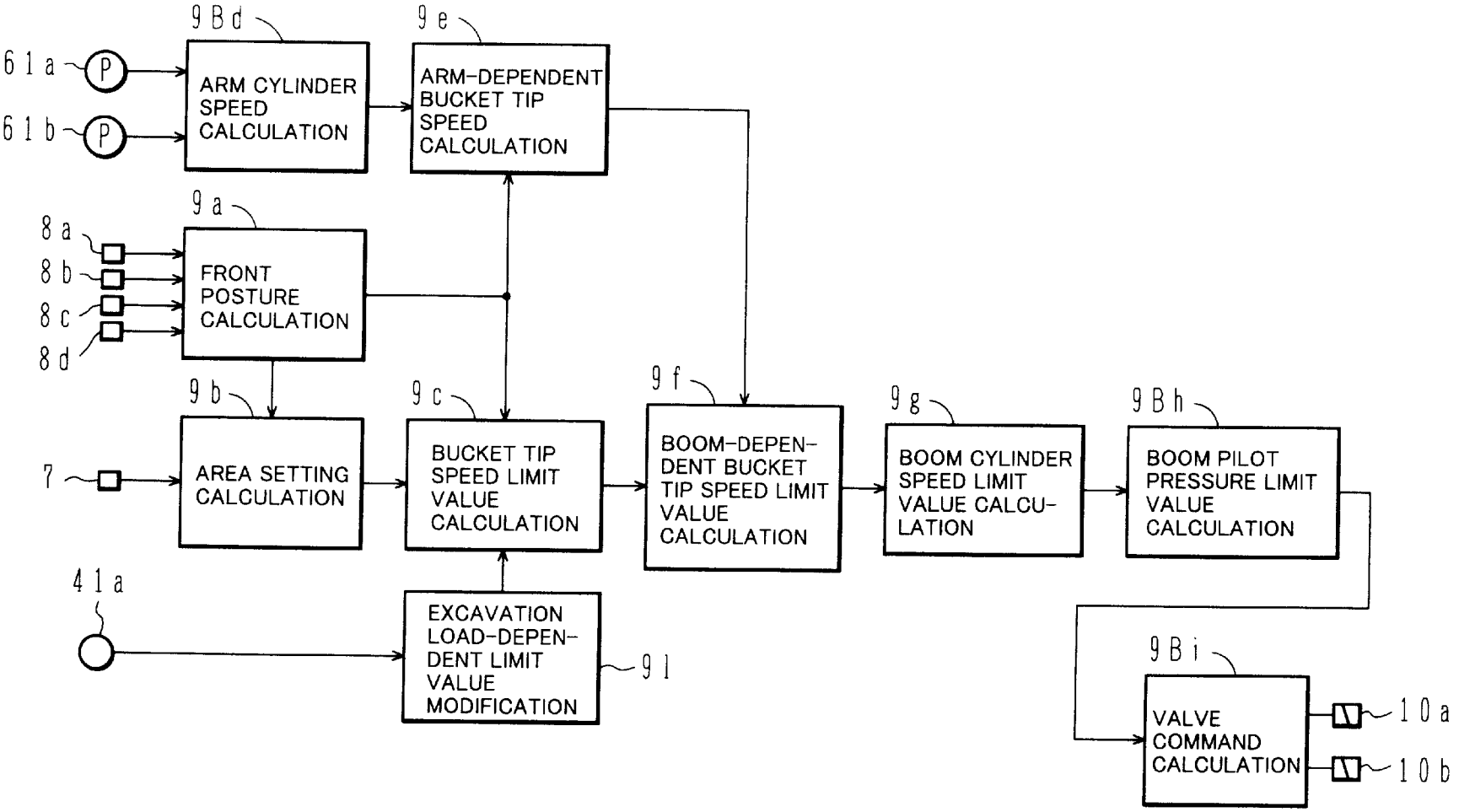
FIG. 17 is a diagram showing control functions of a control unit.

A second embodiment of the present invention will be described with reference to FIGS. 16 and 17. In this embodiment, the present invention is applied to a hydraulic excavator employing control lever units of hydraulic pilot type. In FIGS. 16 and 17, equivalent members or functions to those shown in FIGS. 1 and 3 are denoted by the same symbols.

In FIG. 16, a hydraulic excavator to which this embodiment is applied includes control lever units 4*a*–4*f* of hydraulic pilot type instead of the electric control lever units 14*a*–14*f*. The control lever units 4*a*–4*f* drive associated flow control valves 5*a*–5*f* with respective pilot pressures. Specifically, the control lever units 4*a*–4*f* supply the respective pilot pressures depending on the amounts and directions of inputs, which are entered by the operator manipulating control levers 40*a*–40*f*, to hydraulic driving sectors 50*a*–55*b* of the associated flow control valves through pilot lines 44*a*–49*b*.

An area limiting excavation control system of this embodiment is installed in the hydraulic excavator as explained above. The control system comprises, in addition to the components used in the first embodiment shown in FIG. 1, pressure sensors 61*a*, 61*b* disposed respectively in the pilot lines 45*a*, 45*b* of the arm control lever unit 4*b* for detecting the pilot pressures as input amounts from the control lever unit 4*b*, a proportional solenoid valve 10*a* connected at the primary port side thereof to a pilot pump 43 for reducing and outputting a pilot pressure from the pilot pump 43 in accordance with an electric signal, a shuttle valve 12 connected to the pilot line 44*a* of the boom control lever unit 4*a* and the secondary port side of the proportional solenoid valve 10*a* for selecting the higher of the pilot pressure in the pilot line 44*a* and the control pressure output from the proportional solenoid valve 10*a* and then introducing the selected pressure to the hydraulic driving sector 50*a* of the flow control valve 5*a*, and a proportional solenoid valve 10*b* disposed in the pilot line 44*b* of the boom control lever unit 4*a* for reducing and outputting the pilot pressure in the pilot line 44*b* in accordance with an electric signal.

Differences in control functions of a control unit 9B in this embodiment from the control unit 9 in the first embodiment of FIG. 1 will be described with reference to FIG. 17.

An arm cylinder speed calculating portion 9Bd estimates an arm cylinder speed based on command values (pilot pressures) for the flow control valve 5*b* detected by the pressure sensors 61*a*, 61*b* instead of the command value input from the control lever unit 4*b* for the flow control a valve 5*b*, and the flow rate characteristic of the flow control valve 5*b* associated with the arm.

Also, a boom pilot pressure limit value calculating portion 9Bh determines, based on the flow rate characteristic of the flow control valve 5*a* associated with the boom, a limit value of the boom pilot pressure (command) corresponding to the limit value c of the boom cylinder speed determined in the calculating portion 9*g*.

Furthermore, with the provision of the proportional solenoid valves 10*a*, 10*b* and the shuttle valve 12, the boom command maximum value calculating portion 9*j* is no longer required, and a valve command calculating portion 9Bi functions as follows. When the pilot pressure limit value determined in the boom pilot pressure limit value calculating portion 9Bh is positive, the calculating portion 9Bi outputs a voltage corresponding to the limit value to the proportional solenoid valve 10*a* on the boom raising side so that the pilot pressure applied to the hydraulic driving sector 50*a* of the flow control valve 5*a* is restricted to the limit value, and outputs a zero (0) voltage to the proportional solenoid valve 10*b* on the boom lowering side so that the pilot pressure applied to the hydraulic driving sector 50*b* of the flow control valve 5*a* becomes zero (0). Conversely, when the pilot pressure limit value is negative, the calculating portion 9Bi outputs a voltage corresponding to the limit value to the proportional solenoid valve 10*b* so that the pilot pressure applied to the boom lowering-side hydraulic driving sector 50*b* of the flow control valve is restricted, and outputs a zero (0) voltage to the proportional solenoid valve 10*a* on the boom raising side so that the pilot pressure applied to the hydraulic driving sector 50*a* of the flow control valve 5*a* becomes zero (0).

Operation of this embodiment having the above-explained construction will be described below in connecting with the boom lowering operation and the arm crowding operation similarly to the first embodiment.

When the control lever of the boom control lever unit 4*a* is operated in the boom lowering direction with an intention of positioning the bucket tip, a pilot pressure representing the command value from the control lever unit 4*a* is applied to the boom lowering-side hydraulic driving sector 50*b* of the flow control valve 5*a* through the pilot line 44*b*. At the same time, the calculating portion 9*c* calculates, based on the relationship shown in FIG. 5, a limit value a (<0) of the bucket tip speed in proportion to the distance D from the boundary L of the set area to the bucket tip, the calculating portion 9*f* calculates a limit value c=a−by=a (<0) of the boom-dependent bucket tip speed, and the boom pilot pressure limit value calculating portion 9Bh calculates a negative boom command limit value corresponding to the limit value c. The valve command calculating portion 9Bi outputs a voltage corresponding to the limit value to the proportional solenoid valve 10*b* so that the pilot pressure applied to the boom lowering-side hydraulic driving sector 50*b* of the flow control valve is restricted, and outputs a zero (0) voltage to the proportional solenoid valve 10*a* on the boom raising side so that the pilot pressure applied to the hydraulic driving sector 50*a* of the flow control valve 5*a* becomes zero (0). Here, when the bucket tip is far from the boundary L of the set area, the limit value of the boom pilot pressure determined in the calculating portion 9Bh has a large absolute value, and the pilot pressure from the control lever unit 4*a* is smaller than that absolute value. Therefore, the proportional solenoid valve 10*b* outputs the pilot pressure from the control lever unit 4*a* as it is, whereby the boom is gradually moved down in accordance with the pilot pressure from the control lever unit 4*a*.

As the boom is gradually moved down and the bucket tip comes closer to the boundary L of the set area as mentioned above, the limit value c=a (<0) of the boom-dependent bucket tip speed calculated in the calculating portion 9*f* is increased (the absolute value |a| or |c| is reduced), and an absolute value of the corresponding boom command limit value (<0) determined in the calculating portion 9Bh is reduced. When the absolute value of the limit value becomes smaller than the command value from the control lever unit 4*a* and the voltage output from the valve command calculating portion 9Bi to the proportional solenoid valve 10*b* is reduced correspondingly, the proportional solenoid valve 10*b* reduces and outputs the pilot pressure from the control lever unit 4*a* to gradually restrict the pilot pressure applied to the boom lowering-side hydraulic driving sector 50*b* of the flow control valve 5*a* in accordance with the limit value c. Thus, the boom lowering speed is gradually restricted as the bucket tip approaches the boundary L of the set area, and the boom is stopped when the bucket tip reaches the boundary L of the set area. As a result, the bucket tip can be easily and smoothly positioned.

When the bucket tip goes out beyond the boundary L of the set area, the limit value a (=c) of the bucket tip speed in proportion to the distance D from the boundary L of the set area to the bucket tip is calculated as a positive value in the calculating portion 9*c* based on the relationship shown in FIG. 5, and the valve command calculating portion 9Bi outputs a voltage corresponding the limit value c to the proportional solenoid valve 10*a*, thereby applying the pilot pressure corresponding to the limit value a to the boom raising-side driving sector 50*a* of the flow control valve 5*a*. The boom is thereby moved in the rising direction at a speed proportional to the distance D for moving back toward the set area, and is then stopped when the bucket tip returns to the boundary L of the set area. As a result, the bucket tip can be more easily positioned.

Further, when the control lever of the arm control lever unit 4*b* is operated in the arm crowding direction with an intention of excavating the ground toward the body, a pilot pressure representing the command value from the control lever unit 4*b* is applied to the arm crowding-side hydraulic driving sector 51*a* of the flow control valve 5*b*, causing the arm to move down toward the body. At the same time, the pilot pressure from the control lever unit 4*b* is detected by the pressure sensor 61*a* and then input to the calculating portion 9Bd which calculates an arm cylinder speed, and the calculating portion 9*e* calculates an arm-dependent bucket tip speed b. Also, the calculating portion 9*c* calculates, based on the relationship shown in FIG. 5, a limit value a (<0) of the bucket tip speed in proportion to the distance D from the boundary L of the set area to the bucket tip, and the calculating portion 9*f* calculates a limit value c=a−by of the boom-dependent bucket tip speed. Here, when the bucket tip is so far from the boundary L of the set area as to meet the relationship of a<by (|a|>|by|), the limit value c is calculated as a negative value. Therefore, the valve command calculating portion 9Bi outputs a voltage corresponding to the limit value to the proportional solenoid valve 10*b* so that the pilot pressure applied to the boom lowering-side hydraulic driving sector 50*b* of the flow control valve is restricted, and outputs a zero (0) voltage to the proportional solenoid valve 10*a* on the boom raising side so that the pilot pressure applied to the hydraulic driving sector 50*a* of the flow control valve 5*a* becomes zero (0). At this time, because the control lever unit 4*a* is not operated, no pilot pressure is output to the hydraulic driving sector 50*b* of the flow control valve 5*a*. As a result, the arm is moved toward the body in accordance with the pilot pressure from the control lever unit 4*b*.

As the arm is gradually moved toward the body and the bucket tip comes closer to the boundary L of the set area as mentioned above, the bucket tip speed limit value a calculated in the calculating portion 9*c* is increased (the absolute value |a| is reduced). When the limit value a becomes greater than the component by of the arm-dependent bucket tip speed b vertical to the boundary L determined in the calculating portion 9*e*, the limit value c=a−by of the boom-dependent bucket tip speed calculated in the calculating portion 9*f* is given as a positive value. Accordingly, the valve command calculating portion 9Bi outputs a voltage corresponding to the limit value to the proportional solenoid valve 10*a* on the boom raising side so that the pilot pressure applied to the hydraulic driving sector 50*a* of the flow control valve 5*a* is restricted, and outputs a zero (0) voltage to the proportional solenoid valve 10*b* on the boom lowering side so that the pilot pressure supplied to the hydraulic driving sector 50*a* of the flow control valve 5*a* becomes zero (0). Therefore, the boom raising operation for modifying the bucket tip speed is performed such that the component of the bucket tip speed vertical to the boundary L is gradually restricted in proportion to the distance D from the boundary L to the bucket tip. Thus, direction change control is carried out with a resultant of the unmodified component bx of the arm-dependent bucket tip speed parallel to the boundary L and the above speed modified in accordance with the limit value c, as shown in FIG. 13, enabling the excavation to be performed along the boundary L of the set area.

Here, when the excavation load is enlarged, the hydraulic fluid becomes harder to flow into the arm cylinder 3*b* and the arm speed is lowered, as mentioned above. Therefore, the rising speed of the boom 1*a* becomes relatively too fast under the direction change control, thus causing a phenomenon that the front device tends to move upward.

Also in this embodiment, when the excavation load is enlarged and the bottom-side pressure Pba of the arm cylinder 3*b* is increased, the excavation load-dependent limit value modifying portion 91 modifies the limit value a depending on the arm cylinder load pressure. This modification of the limit value a results in that when the load pressure Pba is high, the limit value a has a sufficiently large value only when the bucket tip comes closer to the boundary L than when the load pressure Pba is low. In other words, the boom raising operation for modifying the bucket tip speed becomes effective when the bucket tip comes closer to the boundary L. Therefore, even when the hydraulic fluid becomes harder to flow into the arm cylinder and the arm speed is lowered, the boom rising speed under the direction change control balances with the lowered arm speed, thereby suppressing the phenomenon that the front device tends to move upward. As a result, even in a condition where the load pressure or the excavation load is large, it is possible to carry out the excavation along the boundary L in a closer relation.

When the bucket tip goes out beyond the boundary of the set area, the limit value a of the bucket tip speed in proportion to the distance D from the boundary L of the set area to the bucket tip is calculated as a positive value in the calculating portion 9*c* based on the relationship shown in FIG. 5, the limit value c=a−by (>0) of the boom-dependent bucket tip speed calculated in the calculating portion 9*f* is increased in proportion to the limit value a, and the voltage output from the valve command calculating portion 9*i* to the proportional solenoid valve 10*a* on the boom raising side is increased in accordance with the limit value c. In the case of the bucket tip being outside the set area, therefore, the boom raising operation for modifying the bucket tip speed is performed so that the bucket tip is moved back toward the set area at a speed proportional to the distance D. Thus, the excavation is carried out with a resultant of the unmodified component bx of the arm-dependent bucket tip speed parallel to the boundary L and the above speed modified in accordance with the limit value c, enabling the excavation to be performed along the boundary L of the set area while the bucket tip is gradually returned to and moved along the boundary L, as shown in FIG. 14. Consequently, the excavation can be smoothly performed along the boundary L of the set area just by crowding the arm.

With this embodiment, as described above, similar advantages to those obtainable with the first embodiment can be obtained in a hydraulic excavator which employ operating means of hydraulic pilot type.

A third embodiment of the present invention will be described with reference to FIGS. 18 to 29. In this embodiment, the present invention is applied to the area limiting excavation control system of all operation signal modifying type disclosed in WO 95/30059. In FIGS. 18 to 29, equivalent members or functions to those shown in FIG. 1 or 16 and FIG. 3 or 17 are denoted by the same symbols.

Figure 18:
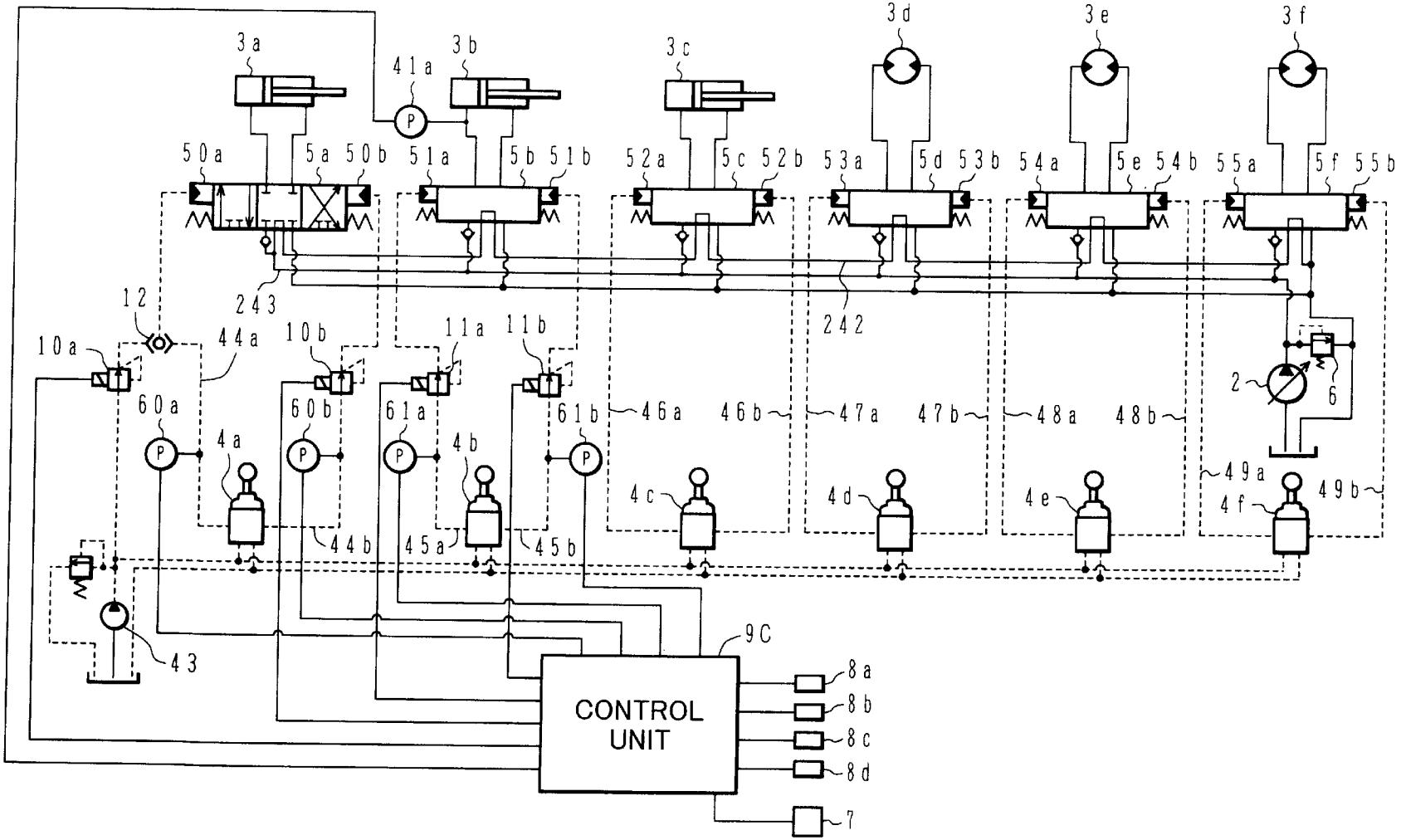
FIG. 18 is a diagram showing an area limiting excavation control system for a construction machine according to a third embodiment of the present invention, along with a hydraulic drive system for the construction machine.

In FIG. 18, an area limiting excavation control system of this embodiment comprises, in addition to the components used in the second embodiment shown in FIG. 16, pressure sensors 60*a*, 60*b* disposed respectively in the pilot lines 44*a*, 44*b* of the boom control lever unit 4*a* for detecting the pilot pressures as input amounts from the control lever unit 4*a*, and proportional solenoid valves 11*a*, 11*b* disposed respectively in the pilot lines 45*a*, 45*b* for the arm for reducing and outputting the pilot pressures in the pilot lines 45*a*, 45*b* in accordance with respective electric signals. Signals from the pressure sensors 60*a*, 60*b* are input to a control unit 9C which issues the signals applied to the proportional solenoid valves 11*a*, 11*b*.

Figure 19:
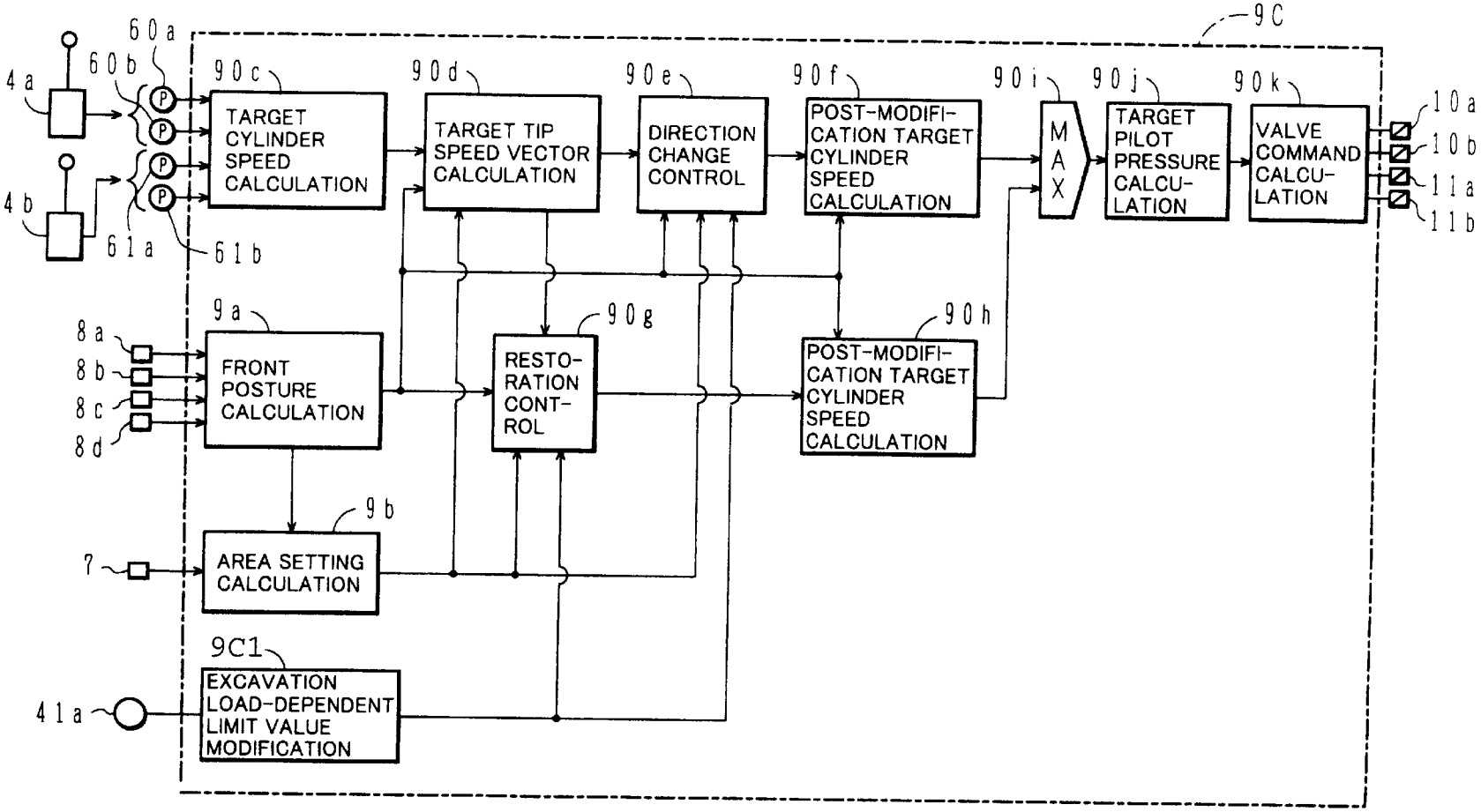
FIG. 19 is a diagram showing control functions of a control unit.

Control functions of the control unit 9C are shown in FIG. 19. The control unit 9C has functions executed by a front posture calculating portion 9*a*, an area setting calculating portion 9*b*, a target cylinder speed calculating portion 90*c*, a target tip speed vector calculating portion 90*d*, a direction change control portion 90*e*, a post-modification target cylinder speed calculating portion 90*f*, a restoration control calculating portion 90*g*, a post-modification target cylinder speed calculating portion 90*h*, an excavation load-dependent limit value modifying portion 9Cl, a target cylinder speed selecting portion 90*i*, a target pilot pressure calculating portion 90*j*, and a valve command calculating portion 90*k*.

The area setting calculating portion 9*a* and the front posture calculating portion 9*b* have the same functions as those in the first embodiment shown in FIG. 3.

The target cylinder speed calculating portion 90*c*receives values of the pilot pressures detected by the pressure sensors 60*a*, 60*b*, 61*a*, 61*b*, determines delivery flow rates through the flow control valves 5*a*, 5*b*, and calculates target speeds of the boom cylinder 3*a* and the arm cylinder 3*b* from the determined delivery flow rates. The target tip speed vector calculating portion 90*d* determines a target speed vector Vc at the tip of the bucket 1*c* from the position of the bucket tip determined in the front posture calculating portion 9*b*, the target cylinder speeds determined in the target cylinder speed calculating portion 90*c*, and the various dimensions of the front device 1A stored in a memory of the control unit 9C. At this time, the target speed vector Vc is determined as values on the XaYa-coordinate system shown in FIG. 4.

In the direction change control portion 90*e*, when the tip of the bucket 1*c* is inside the set area near the boundary thereof and the target speed vector Vc has a component in the direction toward the boundary of the set area, the vertical vector component is modified such that it is gradually reduced as the bucket tip comes closer to the boundary of the set area.

Figure 20:
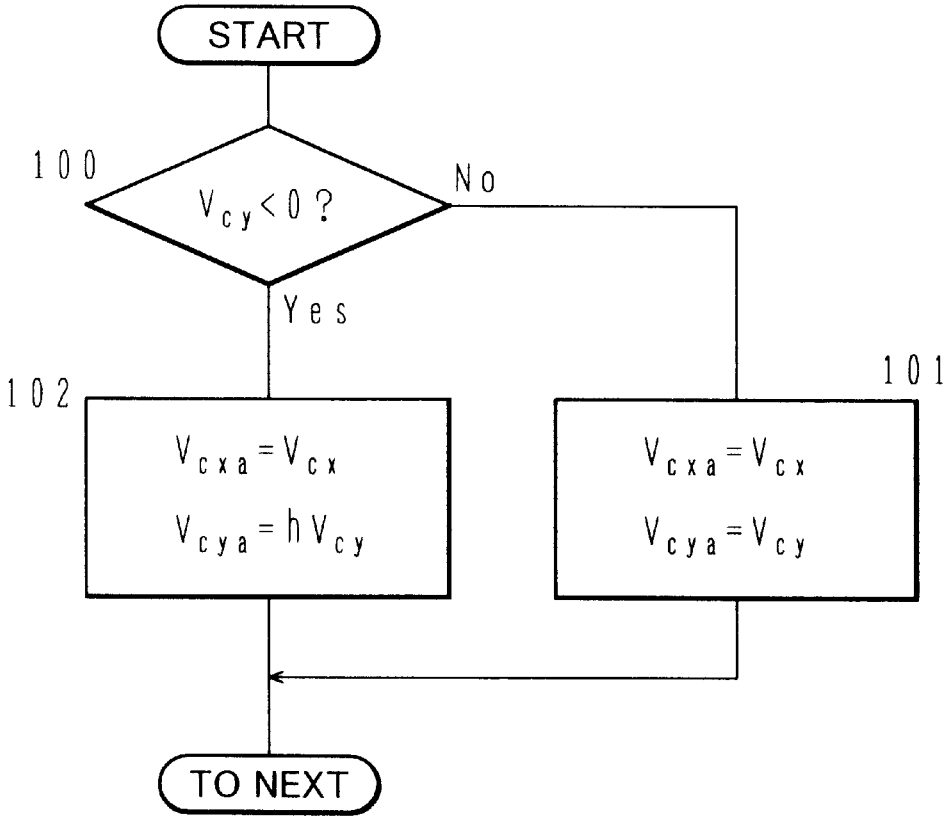
FIG. 20 is a flowchart showing a processing sequence in a direction change control portion.

FIG. 20 is a flowchart showing a control sequence in the direction change control portion 90*e*. First, in step 100, it is determined whether the component of the target speed vector Vc vertical to the boundary of the set area, i.e., the Ya-coordinate value Vcy on the XaYa-coordinate system, is positive or negative. If the Ya-coordinate value Vcy is positive, this means that the speed vector at the bucket tip is oriented so as to move it away from the boundary of the set area. Therefore, the control process goes to step 101 where the Xa-coordinate value Vcx and the Ya-coordinate value Vcy of the target speed vector Vc are set, as they are, to post-modification vector components Vcxa, Vcya, respectively. If the Ya-coordinate value Vcy is negative, this means that the speed vector at the bucket tip is oriented so as to move it closer to the boundary of the set area. Therefore, the control process goes to step 102 where, for implementing the direction change control, the Xa-coordinate value Vcx of the target speed vector Vc is set, as it is, to the post-modification vector component Vcxa, and a value obtained by multiplying the Ya-coordinate value Vcy by a coefficient h is set to the post-modification vector component Vcya.

Figure 21:
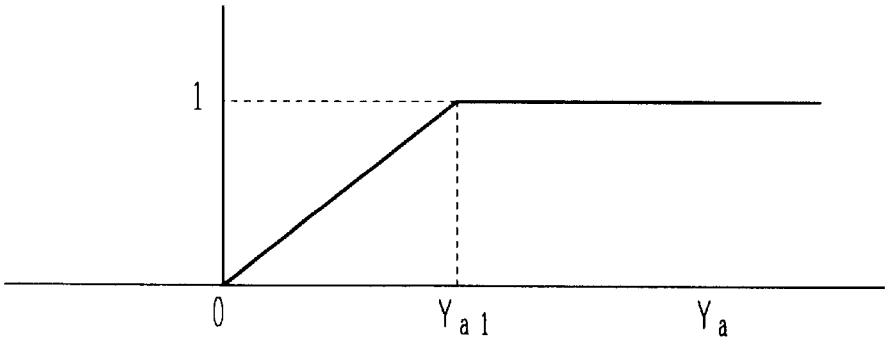
FIG. 21 is a graph showing the relationship between a distance Ya from the bucket tip to the boundary of the set area and a coefficient h for use in the direction change control portion.

Here, as shown in FIG. 21, the coefficient h is a value which takes one (1) when the distance Ya between the tip of the bucket 1*c* and the boundary of the set area is larger than a preset value Ya1, which is gradually reduced from one (1) as the distance Ya decreases when the distance Ya is smaller than the preset value Ya1, and which takes zero (0) when the distance Ya becomes zero (0), i.e., when the bucket tip reaches the boundary of the set area. Such a relationship between h and Ya is stored in the memory of the control unit 9C.

Figure 22:
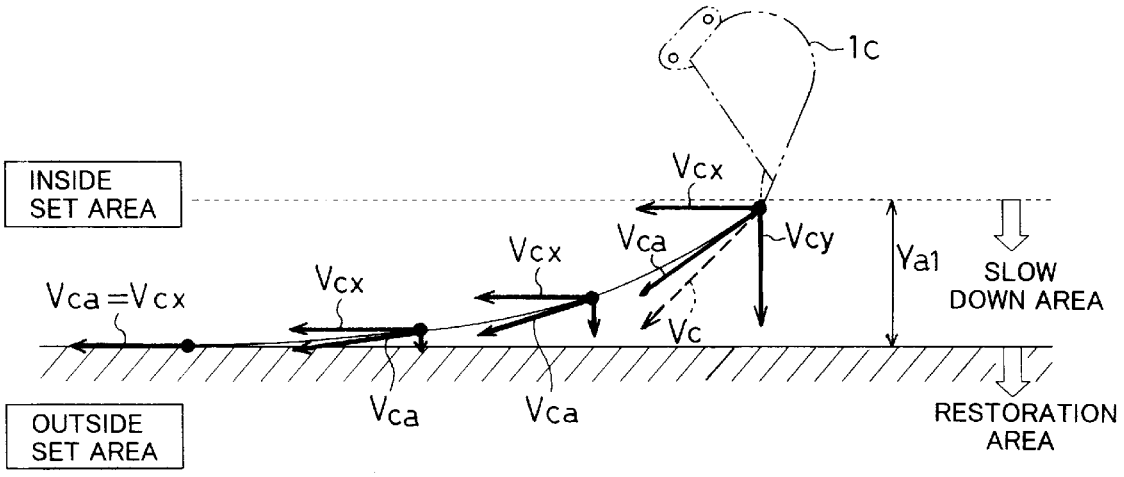
FIG. 22 is a representation showing one example of a locus along which the bucket tip is moved under the direction change control as per calculation.

By modifying the vertical vector component Vcy of the target speed vector Vc as described above, the vertical vector component Vcy is reduced such that the rate of reduction in the vertical vector component Vcy is increased as the distance Ya decreases, whereby the target speed vector Vc is modified into a target speed vector Vca, as shown in FIG. 22. In other words, the coefficient h can be called one kind of limit value because the vertical vector component Vcy is restricted in accordance with the coefficient h when the distance Ya is not more than Ya1.

Figure 23:
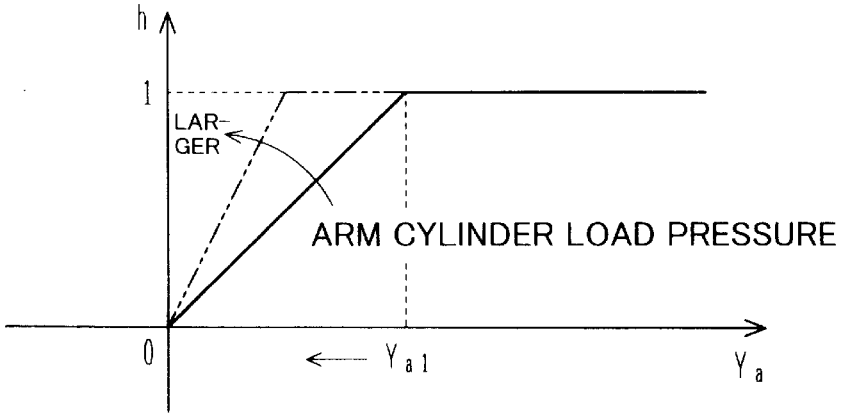
FIG. 23 is a graph showing a manner of modifying the coefficient h depending on an arm cylinder load pressure.

The excavation load-dependent limit value modifying portion 9C1 receives a load pressure Pba of the arm cylinder 3*b* from the pressure sensor 41*a*, and modifies the coefficient h depending on the load pressure Pba. As shown in FIG. 23, the coefficient h is modified to have a larger gradient as the load pressure Pba of the arm cylinder 3*b* increases. Simultaneously, a point Ya1, at which the coefficient h starts reducing with a decrease of the distance Ya, is shifted toward Ya=0. In the direction change control portion 90*e*, the target speed vector Vc is modified using the thus-modified coefficient h. As a result, the target speed vector Vc is modified into Vca and the point Ya1 of starting the direction change comes closer to the boundary (Ya=0). The buckt is hence more surely kept from departing away from the boundary even with a large excavation load. In other words, the coefficient h makes the modification effective at a point closer to the boundary as the excavation load increases.

Figure 24:
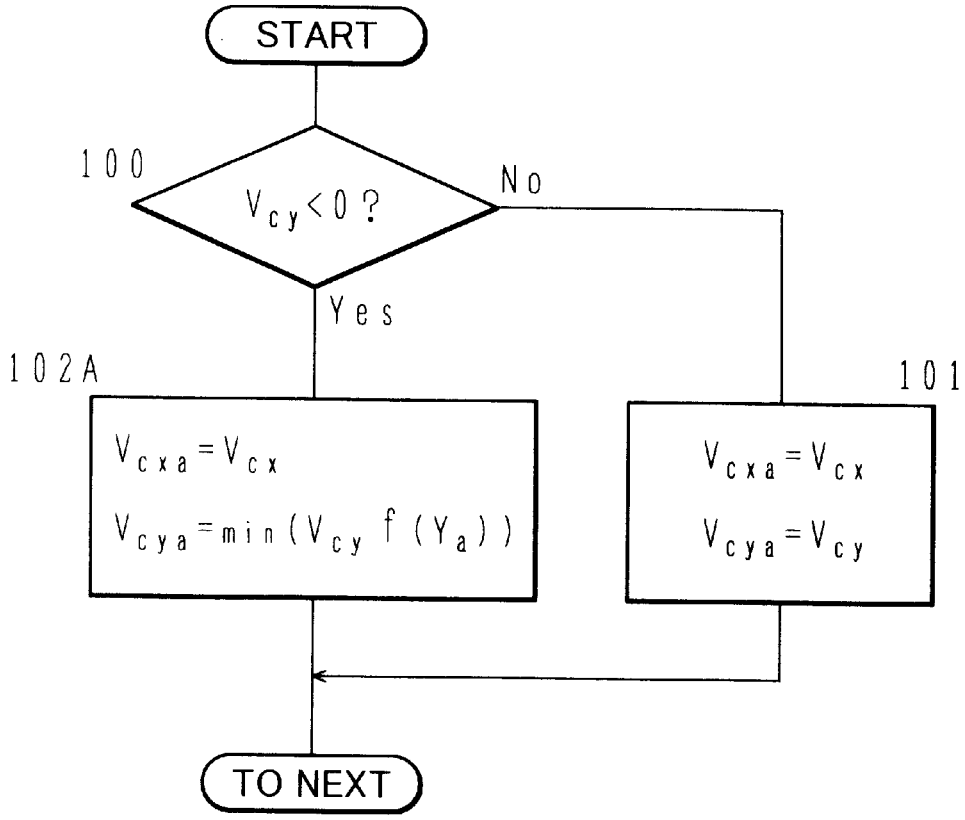
FIG. 24 is a flowchart showing another processing sequence in the direction change control portion.
Figure 25:
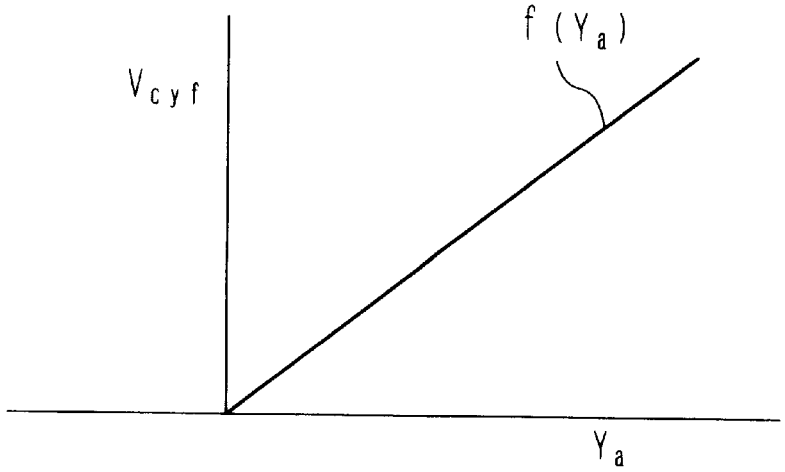
FIG. 25 is a graph showing the relationship between the distance Ya and Vcyf=function f(Ya) for use in the direction change control portion.

FIG. 24 is a flowchart showing another example of the control sequence in the direction change control portion 90*e*. In this example, if the component Vcy of the target speed vector Vc vertical to the boundary of the set area (i.e., the Ya-coordinate value of the target speed vector Vc) is determined to be negative in step 100, the control process goes to step 102A where a slowed-down Ya-coordinate value f(Ya) corresponding to the distance Ya between the tip of the bucket 1*c* and the boundary of the set region is determined from the function relation of Vcyf=f(Ya), shown in FIG. 25, stored in the memory of the control unit 9C, and the smaller of the Ya-coordinate values f(Ya) and Vcy is then set to the post-modification vector component Vcya. This provides an advantage that when the tip of the bucket 1*c* is slowly moved, the bucket speed is not reduced any longer when the bucket tip comes closer to the boundary of the set region, allowing the operator to carry out the operation as per manipulation of the control lever.

Figure 26:
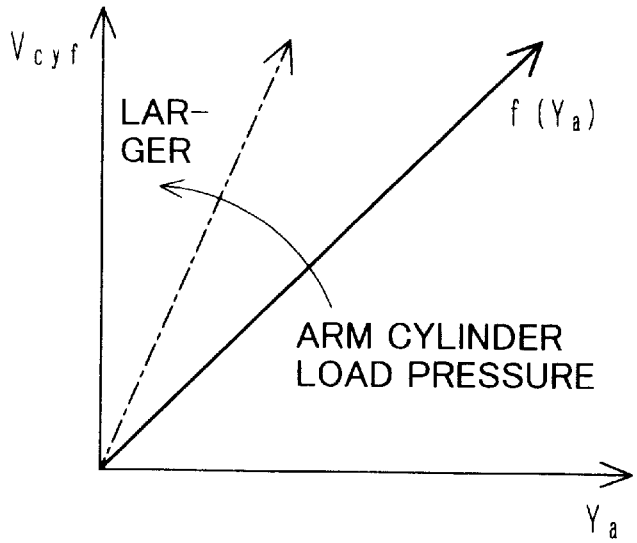
FIG. 26 is a graph showing a manner of modifying a Ya coordinate component depending on the arm cylinder load pressure.

Here, the Ya-coordinate value f(Ya) serves as a limit value for Vcy, and the limit value modifying portion 9Cl modifies the Ya-coordinate value f(Ya) depending on a magnitude of the load pressure Pba of the arm cylinder 3*b*. As shown in FIG. 26, the Ya-coordinate value f(Ya) is also modified to have a larger gradient as the load pressure Pba of the arm cylinder 3*a* increases. In step 102A shown in the flowchart of FIG. 24, therefore, a point, at which the component Vcy of the target speed vector Vc becomes greater than the Ya-coordinate value f(Ya) and f(Ya) is selected instead of Vcy, is shifted toward the boundary (Ya=0). As a result, the buckt is more surely kept from departing away from the boundary even with a large excavation load.

In the restoration control portion 90*g*, when the tip of the bucket 1*c* goes out beyond the set area, the target speed vector is modified depending on the distance from the boundary of the set area to the bucket tip so that the bucket tip is returned to the set area.

Figure 27:
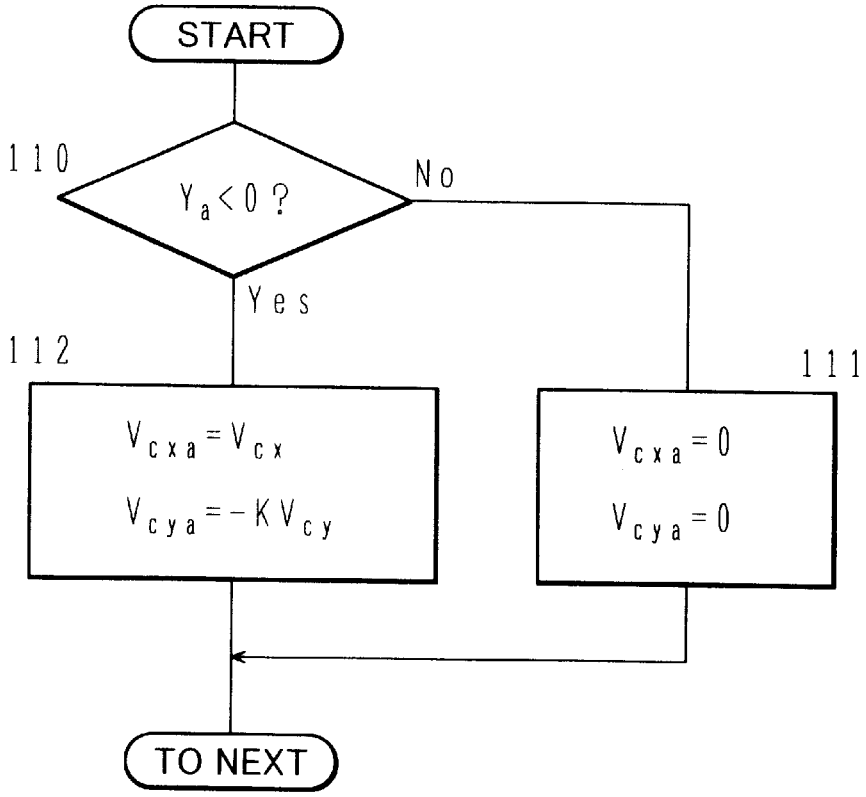
FIG. 27 is a flowchart showing a processing sequence in a restoration control portion.

FIG. 27 is a flowchart showing a control sequence in the restoration control portion 90*g*. First, in step 110, it is determined whether the distance Ya between the tip of the bucket 1*c* and the boundary of the set area is positive or negative. If the distance Ya is positive, this means that the bucket tip is still inside the set area. Therefore, the control process goes to step 111 where the Xa-coordinate value Vcx and the Ya-coordinate value Vcy of the target speed vector Vc are each set to zero (0) to carry out the above-described direction change control with priority. If the distance Ya is negative, this means that the bucket tip has moved out beyond the boundary of the set area. Therefore, the control process goes to step 112 where, for implementing the restoration control, the Xa-coordinate value Vcx of the target speed vector Vc is set, as it is, to the post-modification vector component Vcxa,—and a value obtained by multiplying the Ya-coordinate value Vcy by a coefficient—K is set to the post-modification vector component Vcya of the Ya-coordinate value Vcy. The coefficient K is an optional value which is determined from the viewpoint of control characteristics, and—KVcy represents a speed vector in the reversed direction which becomes smaller as the distance Ya decreases.

Figure 28:
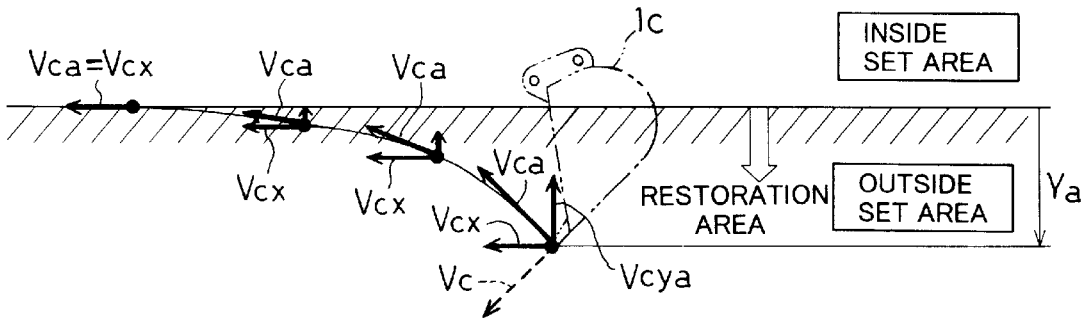
FIG. 28 is a representation showing one example of a locus along which the bucket tip is moved under restoration control as per calculation.

By modifying the vertical vector component Vcy of the target speed vector Vc as described above, the target speed vector Vc is modified into a target speed vector Vca so that the vertical vector component Vcy is reduced as the distance Ya decreases, as shown in FIG. 28.

Figure 29:
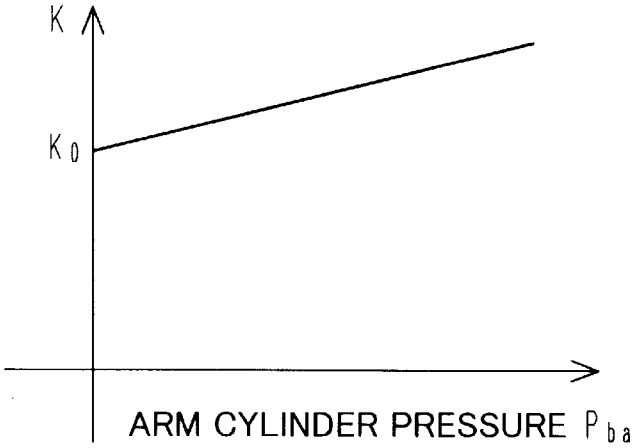
FIG. 29 is a graph showing a manner of modifying a coefficient K for use in the restoration control depending on the arm cylinder load pressure.

In the limit value modifying portion 9Cl, the coefficient K is modified depending on a magnitude of the load pressure Pba of the arm cylinder 3*b*. As shown in FIG. 29, the coefficient K is modified to have a larger value as the load pressure of the arm cylinder 3*b* increases. Thus, the coefficient K is modified in addition to the modification of the coefficient h in the direction change control portion 90*e*, and both control gains under "direction change control" and "restoration control". Accordingly, even when the load is increased and the bucket tip has moved out beyond the boundary because of direction change being not effectuated until coming closer to the boundary under the direction change control, the bucket tip can be controlled to move back toward the boundary.

Incidentally, the coefficient K for use in the restoration control may be set to K=constant if it is not particularly needed to change the coefficient K depending on the load pressure of the arm cylinder 3*b*.

The post-modification target cylinder speed calculating portions 90*f*, 90*h* calculate target cylinder speeds of the boom cylinder 3*a* and-the arm cylinder 3*b* from the modification target speed vectors determined in the control portions 90*e*, 90*g*.

The target cylinder speed selecting portion 90*i* selects the larger (maximum value) of the target cylinder speeds calculated in the target cylinder speed calculating portions 90*f*, 90*h*, and sets it as a target cylinder speed that is to be output.

The target pilot pressure calculating portion 90*j* calculates target pilot pressures in the pilot lines 44*a*, 44*b*, 45*a*, 45*b* from the target cylinder speed which has been selected by the target cylinder speed selecting portion 90*i* to be output.

In the valve command calculating portion 90*k*, from the target pilot pressures calculated in the target pilot pressure calculating portion 90*j*, command values of the proportional solenoid valves 10*a*, 10*b*, 11*a*, 11*b* for providing those target pilot pressures are calculated. The command values are amplified by amplifiers and then output to the proportional solenoid valves in the form of electric signals.

More details of the respective portions from the target cylinder speed calculating portion 90*c* to the valve command calculating portion 90*k* are described in WO 95/30059.

With this embodiment having the above-described construction, when the excavation load is enlarged and the bottom-side pressure Pba of the arm cylinder 3*b* is increased in the area limiting excavation control system of all operation signal modifying type, the coefficient h (or the Ya-coordinate value f(Ya)) is modified depending on the arm cylinder load pressure in the excavation load-dependent limit value modifying portion 9Cl so that the bucket is more surely kept from departing away from the boundary even with a large excavation load. As a result, similar advantages to those obtainable with the first and second embodiments can be obtained.

A fourth embodiment of the present invention will be described with reference to FIGS. 30 to 33. While the limit value is modified depending on the excavation load in the above embodiment, the calculated bucket tip speed is modified depending on the excavation load in this embodiment. In FIGS. 30 to 33, equivalent members or functions to those shown in FIGS. 1 and 3 are denoted by the same symbols.

Figure 30:
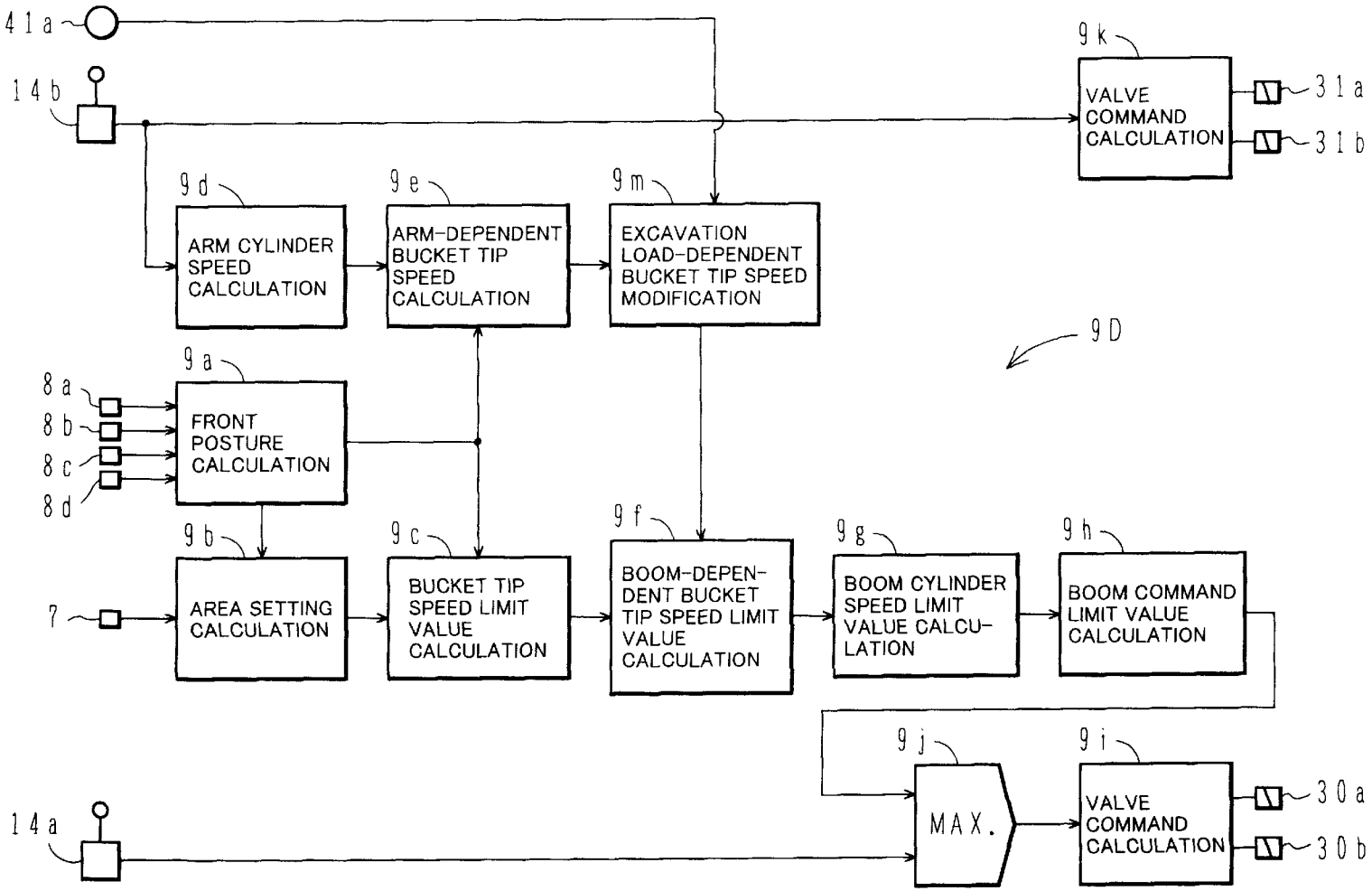
FIG. 30 is a diagram showing control functions of a control unit in an area limiting excavation control system for a construction machine according to a fourth embodiment of the present invention.

Referring to FIG. 30, a control unit 9D in this embodiment includes an excavation load-dependent bucket tip speed modifying portion 9*m*, instead of the excavation load-dependent limit value modifying portion 91 shown in FIG. 3, for modifying the arm-dependent bucket tip speed b calculated in the calculating portion 9*e*.

Figure 31:
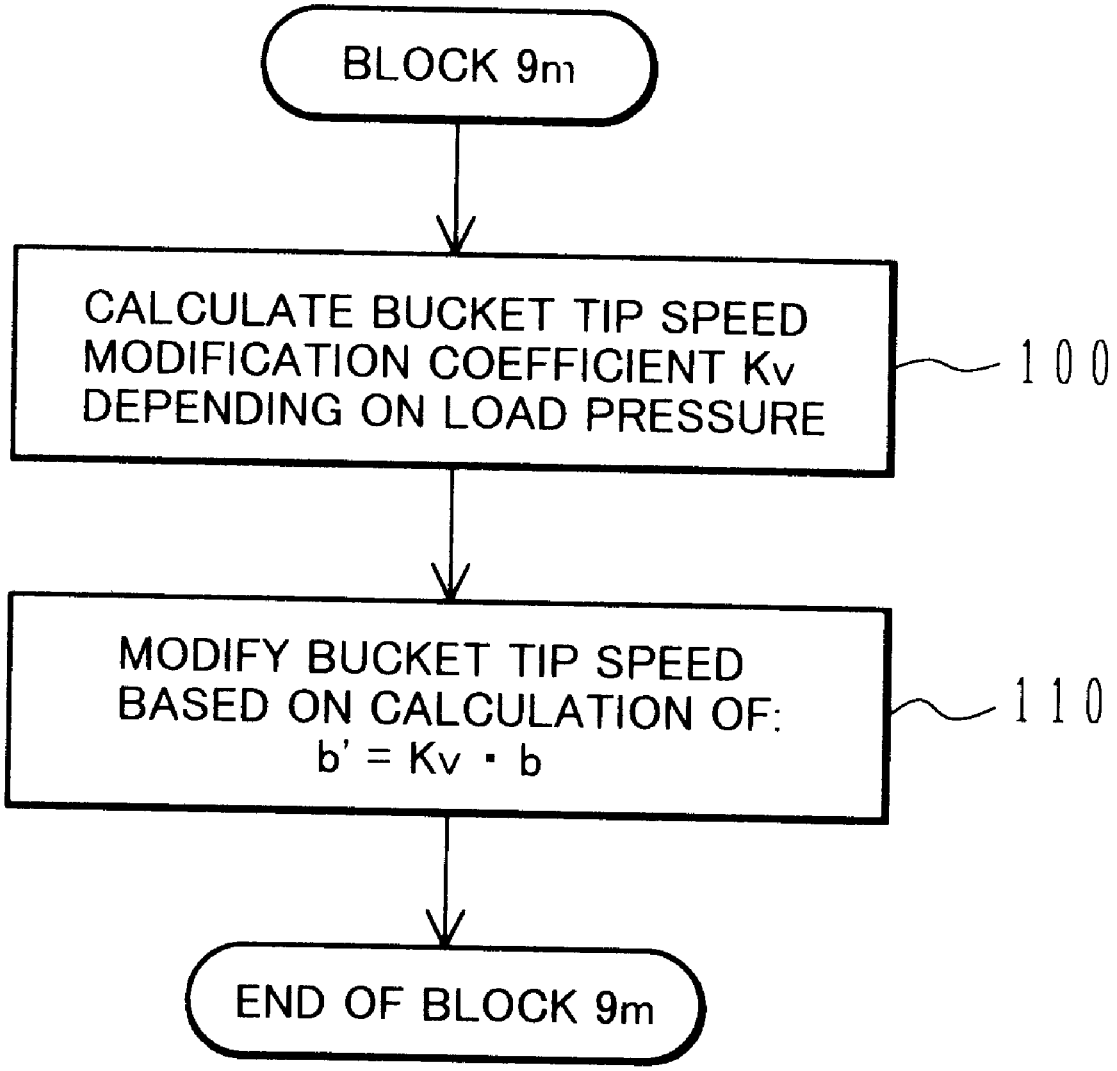
FIG. 31 is a flowchart showing a processing sequence in an excavation load-dependent bucket speed modifying portion.

A calculation sequence in the modifying portion 9*m* is shown in a flowchart of FIG. 31. First, in step 100, the modifying portion 9*m* receives the load pressure Pba of the arm cylinder 3*b* from the pressure sensor 41*a*, and determines a bucket tip speed modification coefficient Kv at that time from a relationship between the arm cylinder pressure Pba and the bucket tip speed modification coefficient Kv shown in FIG. 32. Then, in step 110, the arm-dependent bucket tip speed b is modified, based on the following calculation formula, using the speed modification coefficient Kv determined in step 100:

$$b'=Kv\times b$$

Figure 33:
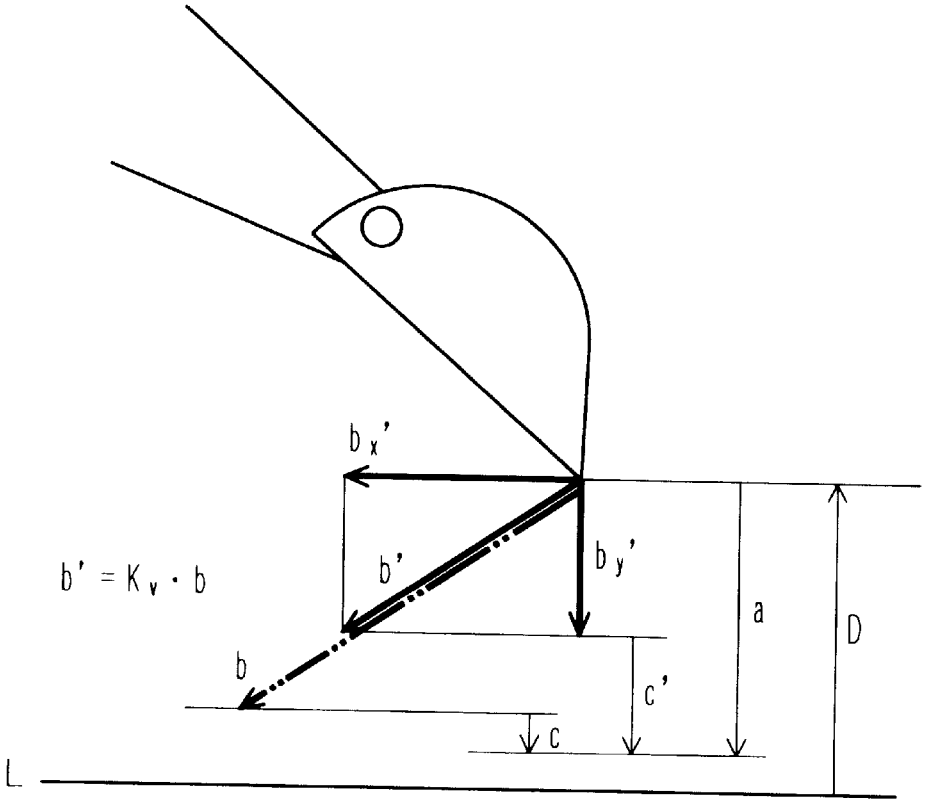
FIG. 33 is a representation for explaining an effect resulted from modifying the bucket tip speed.

According to the above modification process, as shown in FIG. 33, the bucket tip speed b is modified into b' and the speed component thereof vertical to the boundary L of the set area is modified into by'. Therefore, a limit value c' of the boom-dependent bucket tip speed, that is given by a difference between the limit value a and the vertical speed component by' of the speed in a bucket tip position D at that time, becomes larger in the direction toward the boundary L than the limit value c provided in the case including no modification. As a result, a command applied to the boom is reduced correspondingly, and the working device is more surely kept from departing away from the boundary even with a large excavation load.

Figure 32:
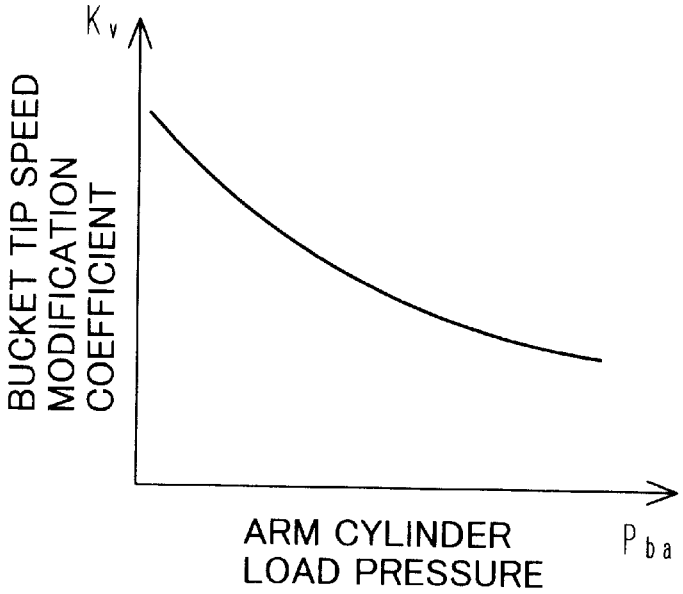
FIG. 32 is a graph showing the relationship between the arm cylinder load pressure and a bucket tip speed modifying coefficient.

In addition, the manner of modifying the speed b in this embodiment is also based on the concept that when excavating the ground imposing a large load, such as hard ground, under the area limiting control, it is enough for the front device to be controlled to finally reach the boundary of the set area without departing away from the boundary, along which the excavation is to be performed, irrespective of the speed vector (locus) of the bucket tip until reaching the boundary. Therefore, an accurate value is not required in the process of modifying the speed b depending on the load pressure, and the control can be performed with rough modification just sufficient to carry out the excavation in such a way that the bucket tip will not depart away from the boundary along which the excavation is to be performed. As a result, the relationship between the load pressure Pba and the modification coefficient Kv, shown in FIG. 32, is also not required to be strictly precise, and software (program) for use in the speed modifying portion 9*m* can be easily prepared.

Thus, modifying the bucket tip speed depending on the excavation load also makes it possible to provide similar advantages to those obtainable with the first embodiment in which the limit value is modified.

In the foregoing embodiments, the distance relative to the boundary of the set area has been described as the distance from the boundary to the bucket tip. From the viewpoint of implementing the present invention in a simpler way, however, a distance from the boundary to a pin at the arm end may be taken instead. Further, when the excavation area is set for the purpose of preventing interference between the front device and any other part, the distance may be taken relative to any other suitable part where the interference may possibly occur.

While the hydraulic drive system to which the present invention is applied has been described as an open circuit system employing the center bypass flow control valves, the present invention is also applicable to a closed circuit system employing closed center flow control valves.

The relationship between the distance from the boundary of the set area to the bucket tip and the limit value of the bucket tip speed or the calculated speed of the bucket tip speed is not restricted to the linearly proportional relationship as described above, but may be set in various ways.

The foregoing embodiments are arranged such that when the bucket tip is away from the boundary of the set area, the target speed vector is output as it is. In such a condition, however, the target speed vector may be modified for any other purpose.

While the vector component of the target speed vector in the direction toward the boundary of the set area has been described as a vector component vertical to the boundary of the set area, it may be deviated from the vertical direction so long as the bucket tip can be moved in the direction along the boundary of the set area.

In the second and third embodiments wherein the present invention is applied to a hydraulic excavator having control lever units of hydraulic pilot type, the proportional solenoid valves are employed as electro-hydraulic converting means and pressure reducing means. However, the proportional solenoid valves may be replaced by any other suitable electro-hydraulic converting means.

Additionally, while the control lever units and the flow control valves are all constructed of hydraulic pilot type in the second and third embodiments, the control lever units and the flow control valves associated with at least the boom and the arm are just required to be constructed of hydraulic pilot type.

According to the present invention, in excavation work using area limiting excavation control, the ground can be excavated to the boundary of a set area without being affected by hardness of the ground to be excavated. It is therefore possible to cut down additional work, improve working efficiency, and to avoid delay of the scheduled term of work. Further, since a process for modifying the limit value or the calculated speed is not required to be strictly precise, the modification process can be implemented with a simple program.

What is claimed is:

1. An area limiting excavation control system installed in a construction machine comprising a multi-articulated front device (1A) constituted by a plurality of front members (1*a*–1*c*) coupled to each other in a relatively vertically rotatable manner, including first and second front members (1*b*, 1*a*), a plurality of hydraulic actuators (3*a*–3*f*) including first and second hydraulic actuators (3*b*, 3*a*) to drive said first and second front members, a plurality of operating means (14*a*–14*f*; 4*a*–4*f*) including first and second operating means (14*b*, 14*a*; 4*b*, 4*a*) to instruct operation of said first and second front members, and a plurality of hydraulic control valves (15*a*–15*f*; 5*a*–5*f*) including first and second hydraulic control valves (15*b*, 15*a*; 5*b*, 5*a*) driven upon operation of said first and second operating means to control respective flow rates of a hydraulic fluid supplied to said first and second hydraulic actuators, said area limiting excavation control system comprising, first calculating means (9*e*; 90*d*) for calculating a moving speed (b; Vc) of said front device (1A) instructed by at least said first operating means (14*b*; 4*b*) among said plurality of operating means, second calculating means (9*c*; 90*e*) for calculating a limit value (a; hVcv; f(Ya)) of a moving speed component in the direction toward a boundary of a set area such that the limit value of the moving speed component is reduced as said front device comes closer to the boundary of said set area, and signal modifying means (9*f*–9*j*; 9*f*–9Bi, 12; 90*e*–90*k*, 12) for modifying an operation signal from at least said second operating means (14*a*; 4*a*) among said plurality of operating means by using the moving speed calculated by said first calculating means and the limit value of the moving speed component calculated by said second calculating means, so that the moving speed of said front device in the direction toward the boundary of said set area is reduced as said front device comes closer to the boundary, while said front device is allowed to move in the direction along the boundary, wherein said area limiting excavation control system for said construction machine further comprises:

first detecting means (41*a*) for detecting a load acting on said front device (1A); and limit value modifying means (91; 9C1) for modifying said limit value (a; hVcv; f(Ya)) of the moving speed component calculated by said second calculating means in accordance with a magnitude of the load detected by said first detecting means; and wherein said limit value modifying means (91; 9C1) modifies said limit value (a; hVcv; f(Ya)) of the moving speed component such that the limit value becomes effective in a position closer to the boundary of said set area as the load acting on said front device (1A) detected by said first detecting means (41*a*) increases.

2. An area limiting excavation control system for a construction machine according to claim 1, wherein the load detected by said first detecting means (41*a*) and acting on said front device (1A) is a load pressure of said first hydraulic actuator (3*b*).

3. An area limiting excavation control system for a construction machine according to claim 1, wherein the load detected by said first detecting means (41*a*) and acting on said front device (1A) is a load pressure of said second hydraulic actuator (3*a*).

4. An area limiting excavation control system for a construction machine according to claim 1, wherein said signal modifying means (9*f*–9*j*; 9*f*–9Bi, 12; 90*e*–90*k*, 12) modifies an operation signal from said second operating means (14*a*; 4*a*) so that a component of the speed of said front device (1A) in the direction toward the boundary of said set area will not exceed said limit value (a; f(Ya)) of the moving speed component.

5. An area limiting excavation control system for a construction machine according to claim 1, wherein the moving speed of said front device (1A) calculated by said first calculating means (90*d*) is a target speed (Vc) of said front device, said second calculating means (90*e*) modifies a component (Vcy) of the target speed of said front device in the direction toward the boundary of said set area with use of a coefficient (h) to provide said limit value (hVcy) of the moving speed component, said limit value modifying means (9C1) includes means for modifying said coefficient (h), and said signal modifying means (90*e*–90*k*, 12) modifies operation signals from said first and second operating means (14*b*, 14*a*; 4*b*, 4*a*) so that the target speed of said front device has a speed component correspondinq to said limit value of the moving speed component.

6. An area limiting excavation control system for a construction machine according to claim 1, wherein said signal modifying means (90*e*–90*k*, 12) modifies operation signals from said first and second operating means (14*b*, 14*a*; 4*b*, 4*a*) so that the target speed of said front device has a speed component modified not to exceed said limit value (f(Ya)) of the moving speed component.

7. An area limiting excavation control system for a construction machine according to claim 1, wherein speed limiting means (9*m*) for modifying the moving speed (b; Vc) of said front device calculated by said first calculating means (9*e*; 90*d*) to limit the same in accordance with a magnitude of the load detected by said first detecting means (41*a*) is provided instead of said limit value modifying means (91; 9C1); and wherein said speed limiting means (9m) modifies said moving speed (b; Vc) such that the limitation of the moving speed becomes effective in a position closer to the boundary of said set area as the load acting on said front device (1A) detected by said first detecting means (41*a*) increases.

8. An area limiting excavation control system for a construction machine according to claim 1, wherein said plurality of front members include a boom (1*a*) and an arm (1*b*) of a hydraulic excavator, said first front member is the arm (1*b*), and said second front member is the boom (1*a*).

* * * * *